US009817335B2

(12) United States Patent
Kawashima et al.

(10) Patent No.: US 9,817,335 B2
(45) Date of Patent: Nov. 14, 2017

(54) POWDER AMOUNT DETECTOR, POWDER SUPPLY DEVICE, AND IMAGE FORMING APPARATUS INCORPORATING SAME

(71) Applicants: Naohiro Kawashima, Kanagawa (JP); Koichi Yamazaki, Kanagawa (JP); Nobuo Takami, Kanagawa (JP); Atsushi Nakamoto, Kanagawa (JP); Shinnosuke Koshizuka, Kanagawa (JP); Tatsuya Kubo, Kanagawa (JP); Kazunori Suzuki, Kanagawa (JP); Hiroshi Hosokawa, Kanagawa (JP); Tetsuro Hirota, Kanagawa (JP); Kenji Kikuchi, Kanagawa (JP)

(72) Inventors: Naohiro Kawashima, Kanagawa (JP); Koichi Yamazaki, Kanagawa (JP); Nobuo Takami, Kanagawa (JP); Atsushi Nakamoto, Kanagawa (JP); Shinnosuke Koshizuka, Kanagawa (JP); Tatsuya Kubo, Kanagawa (JP); Kazunori Suzuki, Kanagawa (JP); Hiroshi Hosokawa, Kanagawa (JP); Tetsuro Hirota, Kanagawa (JP); Kenji Kikuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/280,268

(22) Filed: Sep. 29, 2016

(65) Prior Publication Data

US 2017/0115597 A1 Apr. 27, 2017

(30) Foreign Application Priority Data

Oct. 21, 2015 (JP) ..... 2015-207552
Dec. 11, 2015 (JP) ..... 2015-242048
(Continued)

(51) Int. Cl.
*G03G 15/08* (2006.01)

(52) U.S. Cl.
CPC ..... *G03G 15/0831* (2013.01)

(58) Field of Classification Search
USPC ..... 399/24, 25, 27–30, 38, 53, 61, 111, 119, 399/120, 252, 258, 261
See application file for complete search history.

(56) References Cited

U.S. PATENT DOCUMENTS 5,036,363 A * 7/1991 Iida ..... G03G 15/0856 118/689
6,345,163 B1 * 2/2002 Suzuki ..... G03G 15/0822 399/255
(Continued)

FOREIGN PATENT DOCUMENTS

JP 6-059049 3/1994
JP 2011-215588 10/2011
JP 2013-037280 2/2013

*Primary Examiner* — Hoan Tran
(74) *Attorney, Agent, or Firm* — Oblon, McClelland, Maier & Neustadt, L.L.P.

(57) ABSTRACT

A powder amount detector includes a vibration plate secured to a powder container to contain powder and positioned at a predetermined position in a stationary state, a shaft to rotate inside the powder container, a contact member attached to the shaft, a vibration detector to detect vibration of the vibration plate, and a detection result processor to determine an amount of the powder in the powder container according to a detection result generated by the vibration detector. The contact member is to flip the vibration plate to cause the vibration plate to repeat elastic deformation and reversion to vibrate. The contact member is to exit an area opposed to the vibration plate after the contact member flips the vibration plate by the time the vibration plate returns to the predetermined position.

20 Claims, 25 Drawing Sheets

(30) Foreign Application Priority Data

Apr. 4, 2016 (JP) ..... 2016-075320
Jun. 2, 2016 (JP) ..... 2016-110835

(56) References Cited

U.S. PATENT DOCUMENTS

| | | | | |
|---|---|---|---|---|
| 8,405,878 | B2 * | 3/2013 | Kang | H04N 1/4055 358/3.06 |
| 2011/0182626 | A1 | 7/2011 | Hirota et al. | |
| 2011/0222871 | A1 | 9/2011 | Suzuki et al. | |
| 2015/0323884 | A1 | 11/2015 | Kikuchi et al. | |
| 2015/0346635 | A1 | 12/2015 | Nodera et al. | |
| 2016/0116860 | A1 | 4/2016 | Hirota et al. | |
| 2016/0170328 | A1 | 6/2016 | Hosokawa et al. | |
| 2016/0195846 | A1 | 7/2016 | Koshizuka et al. | |

* cited by examiner

| n | 0 | 1 | 2 | 3 | 4 | 5 | 6 | 7 | 8 | 9 | 10 | 11 | ... |
|---|---|---|---|---|---|---|---|---|---|---|---|---|---|
| $S_n$ | 3400 | 3390 | 3360 | 3340 | 3310 | 3300 | 3310 | 3320 | 3350 | 3370 | 3380 | 3370 | |
| $S_{n-1} - S_n$ | − | + | + | + | + | + | − | − | − | − | − | + | |

POWDER AMOUNT DETECTOR, POWDER SUPPLY DEVICE, AND IMAGE FORMING APPARATUS INCORPORATING SAME

CROSS-REFERENCE TO RELATED APPLICATIONS

This patent application is based on and claims priority pursuant to 35 U.S.C. §119(a) to Japanese Patent Application Nos. 2015-207552 filed on Oct. 21, 2015, 2015-242048 filed on Dec. 11, 2015, 2016-075320 filed on Apr. 4, 2016, and 2016-110835 filed on Jun. 2, 2016 in the Japan Patent Office, the entire disclosure of each of which is hereby incorporated by reference herein.

BACKGROUND

Technical Field

Embodiments of the present invention generally relate to a powder amount detector, a powder supply device, and an image forming apparatus, such as a copier, a printer, a facsimile machine, or a multifunction peripheral having at least two of copying, printing, facsimile transmission, plotting, and scanning capabilities.

Description of the Related Art

There are powder amount detectors to detect the amount of powder in a powder container.

SUMMARY

In an embodiment, a powder amount detector includes a vibration plate secured to a powder container to contain powder, a shaft to rotate inside the powder container, a contact member attached to the shaft, a vibration detector to detect vibration of the vibration plate, and a detection result processor to determine an amount of the powder in the powder container according to a detection result generated by the vibration detector. The contact member flips the vibration plate to cause the vibration plate to repeat elastic deformation and reversion to vibrate. The contact member is to exit an area opposed to the vibration plate after the contact member flips the vibration plate by the time the vibration plate returns to a predetermined position in a stationary state.

In another embodiment, a powder supply device includes the powder container to store the powder, an upstream powder supply passage to connect the powder container to an upstream container from which the powder is supplied to the powder container, a downstream powder supply passage to connect the powder container to a destination to which the powder is supplied from the powder container, and the above-described powder amount detector to detect the amount of the powder in the powder container.

In yet another embodiment, an image forming apparatus includes an image bearer to bear a latent image, a developing device to develop the latent image on the image bearer with developer, the upstream container to contain the developer supplied to the developing device, and the above-described powder supply device to supply the developer to the developing device.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
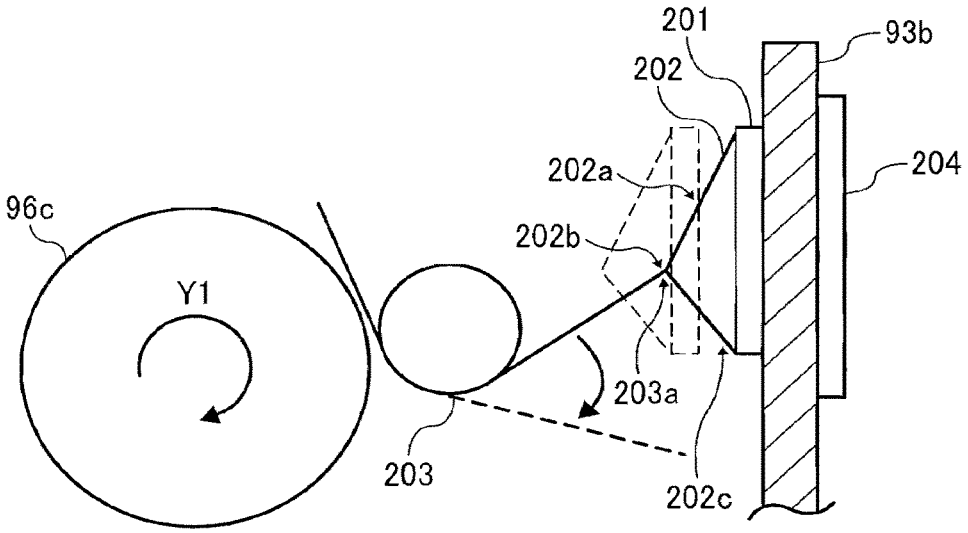
FIG. 1 is a schematic view of a torsion spring attached to a rotation shaft that rotates clockwise, according to an embodiment.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, a powder amount detector according to an embodiment and a multicolor image forming apparatus incorporating the powder amount detector are described.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

Embodiment 1

As an example, descriptions are given below of detection of the amount of developer (i.e., powder) including toner and carrier, in an electrophotographic image forming apparatus. In particular, the present embodiment concerns detection of the amount of developer in a sub-hopper to temporarily store developer between a developing device (a destination), which develops an electrostatic latent image on a photoconductor, and an upstream container from which the developer is supplied to the developing device. Although the developer in the present embodiment is a mixture of toner and carrier, the powder can be one-component developer (i.e., toner) or another powder usable for image formation.

Figure 2:
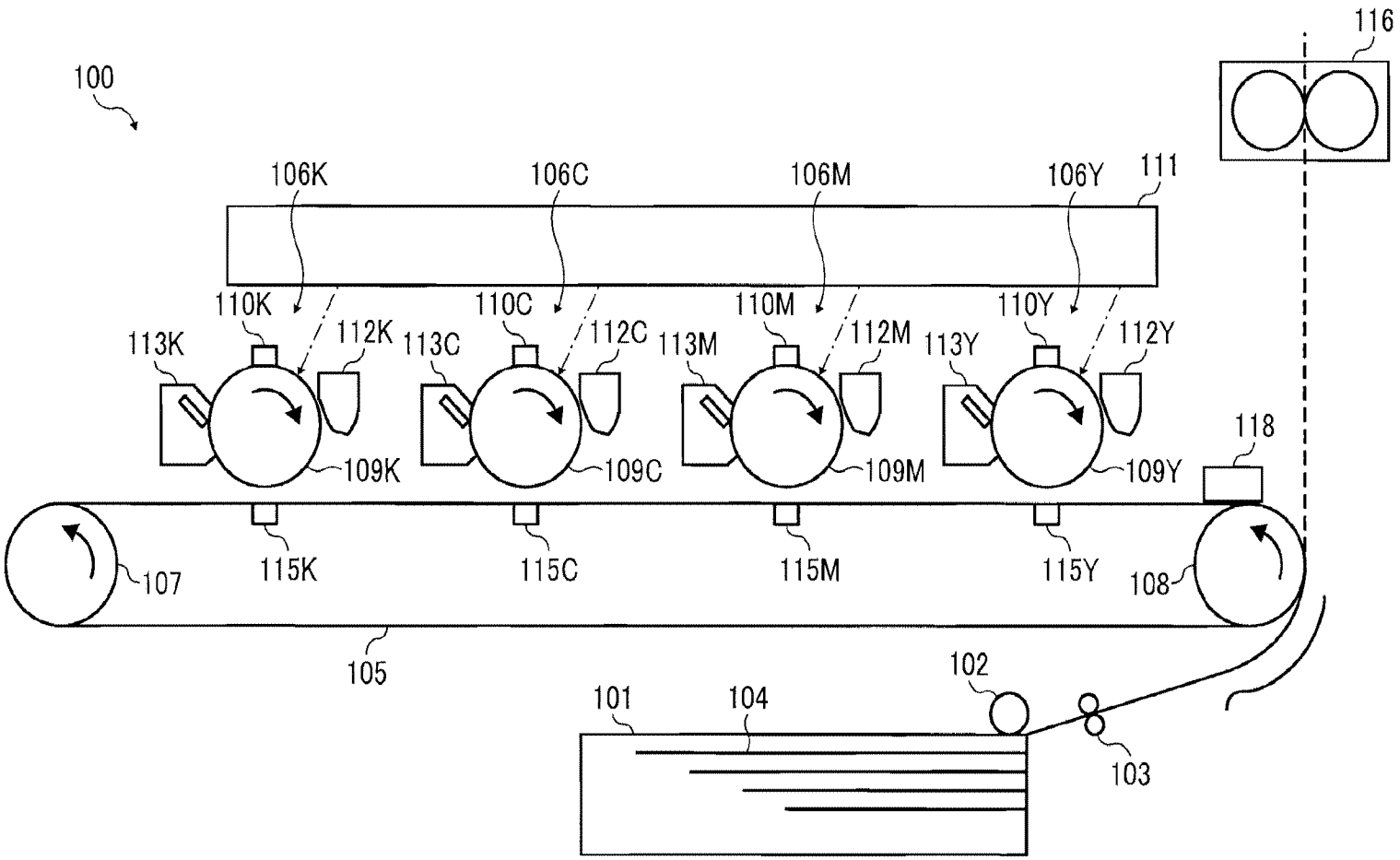
FIG. 2 is a schematic diagram illustrating an image forming apparatus according to an embodiment.

FIG. 2 is a schematic view of an image forming apparatus 100 according to the present embodiment.

As illustrated in FIG. 2, the image forming apparatus 100 employs a so-called tandem system and includes image forming units 106K, 106C, 106M, and 106Y (collectively "image forming units 106") corresponding to different colors, lined along an intermediate transfer belt 105.

The image forming apparatus 100 includes a sheet feeding tray 101 and a sheet feeding roller 102 to feed sheets 104 from the sheet feeding tray 101. A registration roller pair 103 stops the sheet 104 and forwards the sheet 104 to a secondary transfer position where the image is transferred from the intermediate transfer belt 105, timed to coincide with image formation in the image forming units 106. Although the colors of toner images formed thereby are different, the multiple image forming units 106 are similar in internal structure. The image forming unit 106K forms black toner images, the image forming unit 106M forms magenta toner images, the image forming unit 106C forms cyan toner images, and the image forming unit 106Y forms yellow toner images.

The image forming unit 106Y is described in detail below.

Since the image forming units 106 have a similar structure, descriptions of the image forming units 106M, 106C, and 106K are omitted. The intermediate transfer belt 105 is an endless belt entrained around a driving roller 107 and a driven roller 108. The driving roller 107, a driving motor to rotate the driving roller 107, and the driven roller 108 together drive the intermediate transfer belt 105.

From the image forming unit 106Y, which is extreme upstream among the image forming units 106 in a conveyance direction of the intermediate transfer belt 105, a black toner image is transferred onto the intermediate transfer belt 105. The image forming unit 106Y includes a photoconductor drum 109Y and components disposed around the photoconductor drum 109Y, namely, a charging device 110Y, a developing device 112Y, a photoconductor cleaner 113Y, and a discharger. The image forming unit 106Y and an optical writing device 111 together serve as an image forming section. The optical writing device 111 is configured to irradiate, with light, the photoconductor drums 109Y, 109M, 109C, and 109K (collectively "photoconductor drums 109").

To form images, the charging device 110Y uniformly charges the outer face of the photoconductor drum 109Y in the dark, after which the optical writing device 111 directs light from a light source corresponding to yellow images to the photoconductor drum 109Y. Thus, an electrostatic latent image is formed on the photoconductor drum 109Y. The developing device 112Y develops the electrostatic latent image into a visible image with yellow toner. Thus, a yellow toner image is formed on the photoconductor drum 109Y. A transfer device 115Y transfers the toner image onto the intermediate transfer belt 105 at a primary transfer position, where the photoconductor drum 109Y contacts or is closest to the intermediate transfer belt 105. Thus, the yellow toner image is formed on the intermediate transfer belt 105. Subsequently, the photoconductor cleaner 113Y removes toner remaining on the outer face of the photoconductor drum 109Y, and the discharger discharges the outer face of the photoconductor drum 109Y. Then, the photoconductor drum 109Y is on standby for subsequent image formation.

The yellow toner image formed on the intermediate transfer belt 105 by the image forming unit 106Y is then transported to the image forming unit 106M as the intermediate transfer belt 105 rotates. The image forming unit 106M forms a magenta toner image on the photoconductor drum 109M through the processes similar to the processes performed by the image forming unit 106Y. The magenta toner image is transferred from the photoconductor drum 109 and superimposed on the yellow toner image. While rotating, the intermediate transfer belt 105 transports the yellow and magenta toner images further to the image forming units 106C and 106K. Then, cyan and black toner images are transferred from the photoconductor drums 109C and 109K, respectively, and superimposed on the toner image on the intermediate transfer belt 105. Thus, a multicolor (i.e., full-color) intermediate toner image is formed on the intermediate transfer belt 105.

The sheets 104 contained in the sheet feeding tray 101 are sent out from the top sequentially. At a position where a conveyance path of the sheet 104 contacts or is closest to the intermediate transfer belt 105, the intermediate toner image is transferred from the intermediate transfer belt 105 onto the sheet 104. Thus, an image is formed on the sheet 104. The sheet 104 carrying the image is transported to a fixing device 116, where the image is fixed on the sheet 104. Then, the sheet 104 is ejected outside the image forming apparatus 100. The intermediate transfer belt 105 is provided with a belt cleaner 118. The belt cleaner 118 includes a cleaning blade pressed against the intermediate transfer belt 105 to scrape off toner from the surface of the intermediate transfer belt 105 at a position downstream from the secondary transfer position and upstream from the photoconductor drums 109 in the direction in which the intermediate transfer belt 105 rotates.

Figure 3:
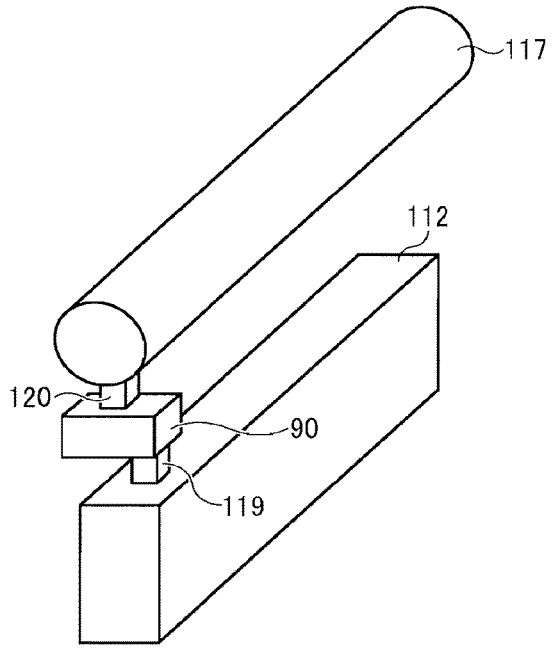
FIG. 3 is a perspective view illustrating a structure to supply developer according to an embodiment.

Referring to FIG. 3, descriptions are given below of structures for developer supply to the developing devices 112, which are similar among cyan (C), magenta (M), yellow (Y), and black (B). Thus, FIG. 3 illustrates the structure to supply the developer to one of the four developing devices 112.

The developer is contained in a developer bottle 117. In FIG. 3, a first developer supply passage 119 (i.e., a downstream powder supply passage) extends from a sub-hopper 90 (i.e., a temporary powder container) to the developing device 112, and a second developer supply passage 120 (i.e., an upstream powder supply passage) extends from the developer bottle 117 to the sub-hopper 90. The developer is supplied from the developer bottle 117 through the second developer supply passage 120 to the sub-hopper 90. The sub-hopper 90 temporarily stores the developer supplied from the developer bottle 117 and supplies the developer to the developing device 112 according to the amount of developer remaining in the developing device 112. From the sub-hopper 90, the developer is supplied through the first developer supply passage 119 to the developing device 112.

Figure 4:
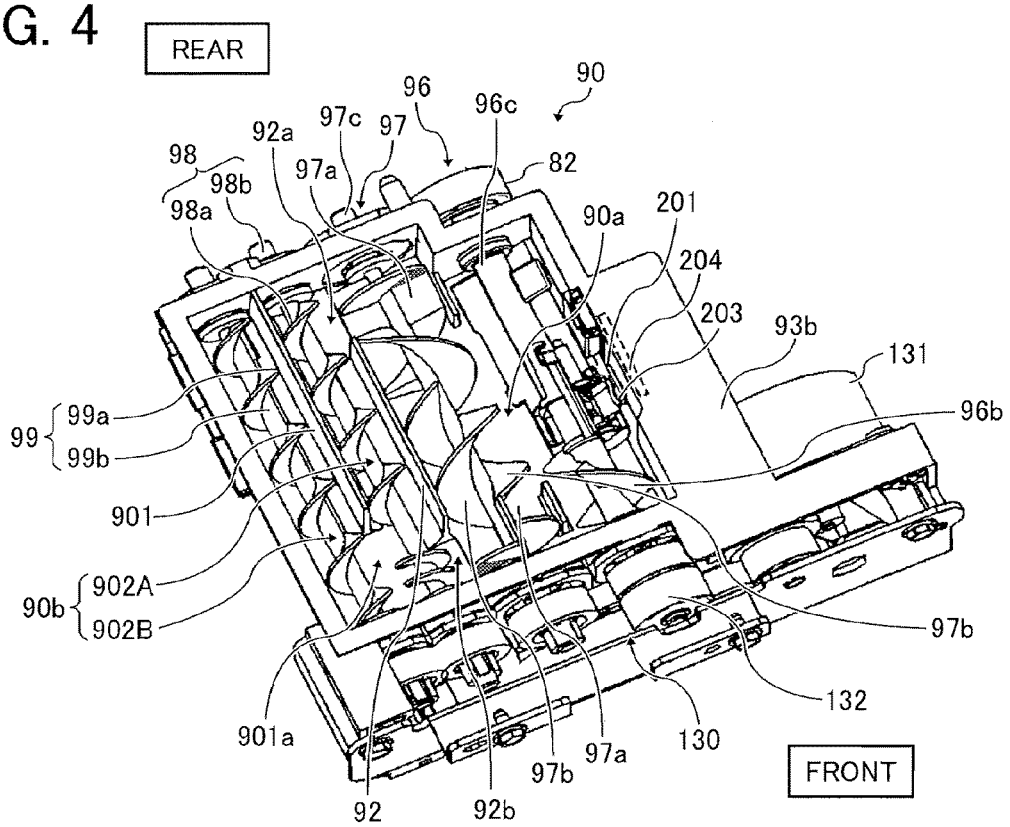
FIG. 4 is a perspective view illustrating an interior of a sub-hopper in the structure illustrated in FIG. 3.

FIG. 4 is a perspective view illustrating an interior of the sub-hopper 90. The upper side of the sub-hopper 90 is open in FIG. 4.

As illustrated in FIG. 4, the sub-hopper 90 contains a first stirring conveyor 96, a second stirring conveyor 97, a first conveyor 98, and a second conveyor 99. The sub-hopper 90 includes a developer reservoir 90*a* to temporarily store the developer supplied from the developer bottle 117 and a conveyance compartment 90*b* to transport the stored developer to the developing device 112. The developer reservoir 90*a* is separated from the conveyance compartment 90*b* by a partition 92. First and second openings 92*a* and 92*b* are secured at both ends of the partition 92. The first opening 92*a* is on the rear side (upper side in FIG. 4 or a driving unit side), and the second opening 92*b* is on the front side (lower side in FIG. 4).

The first stirring conveyor 96 and the second stirring conveyor 97 are disposed side by side in the developer reservoir 90*a*. On the right wall (in FIG. 4) of a casing 93*b* of the sub-hopper 90, a magnetic flux sensor 204 is disposed. On the inner face of the right wall (in FIG. 4) of the casing 93*b*, a vibration plate 201 is disposed to face the magnetic flux sensor 204 via the casing 93*b*. The first stirring conveyor 96, which is disposed on the right side in FIG. 4 of the developer reservoir 90*a*, includes a rotation shaft 96*c* and a spiral screw blade 96*b* whose pitch is relatively large. Additionally, a torsion spring 203 to flip the vibration plate 201 is disposed on the first stirring conveyor 96. The second stirring conveyor 97, which is on the side of the partition 92 (left side in FIG. 4) in the developer reservoir 90*a*, includes a rotation shaft 97*c*, a spiral blade 97*b* whose pitch is relatively large, and paddles 97*a*. The paddles 97*a* are disposed on the rotation shaft 97*c* and positioned to face the first opening 92*a* and the second opening 92*b*, respectively.

The conveyance compartment 90*b* is partitioned by a partition 901 into a first passage 902A and a second passage 902B. An opening 901*a* for conveyance is disposed on the front side of the partition 901 so that the first passage 902A and the second passage 902B communicate with each other. The first conveyor 98 is disposed in the first passage 902A, and the second conveyor 99 is disposed in the second passage 902B. The first conveyor 98 has a rotation shaft 98*b* and a spiral blade 98*a*. The second conveyor 99 has a rotation shaft 99*b* and a spiral blade 99*a*. The pitch of the spiral blade 98*a* of the first conveyor 98 is reduced in a range facing the opening 901*a*.

The pitch of the spiral blade 99*a* of the second conveyor 99 is uniform in the axial direction thereof. The first conveyor 98 transports the developer in the first passage 902A toward the opening 901*a* (from the rear side to the front side). The second conveyor 99 transports the developer in the second passage 902B from the front side to the rear side. The downstream end of the second passage 902B communicates with a developer outlet formed in the bottom of the casing 93*b*. The developer outlet communicates with a supply inlet of the developing device 112. The developer transported through the second passage 902B by the second conveyor 99 is supplied through the developer outlet to the developing device 112.

The sub-hopper 90 is provided with a driving part 130 used in supplying developer to the developing device 112. The driving part 130 is disposed on the front side of the sub-hopper 90 and includes a driving motor 131 and a gear train including multiple gears. The driving force of the driving motor 131 is transmitted from a lower end in FIG. 4 of the rotation shaft 96*c* of the first stirring conveyor 96 via a one-way clutch 132 to the first stirring conveyor 96. Then, the first stirring conveyor 96 rotates. The driving force of the driving motor 131 is transmitted further from the first stirring conveyor 96 via the multiple gears to the second stirring conveyor 97. Then, the second stirring conveyor 97 rotates. Additionally, the driving force of the driving motor 131 is transmitted via the multiple gears to the first and second conveyors 98 and 99. Then, the first and second conveyors 98 and 99 rotate.

In the present embodiment, the developer reservoir 90*a* stores the developer. Even when the developer bottle 117 becomes empty, the developer can be supplied from the developer reservoir 90*a* to the developing device 112. With this structure, preferable images can be produced while uses are preparing a new developer bottle 117.

Figure 5:
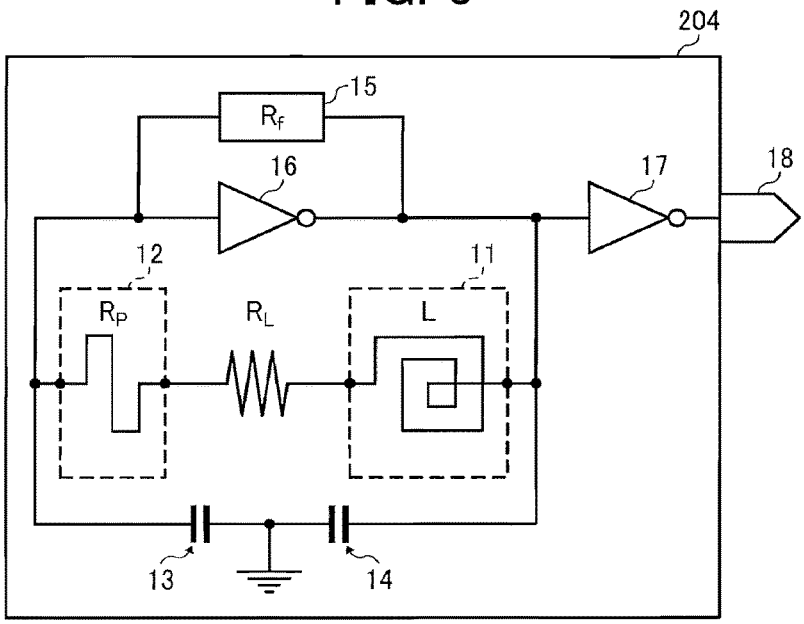
FIG. 5 illustrates circuitry of a magnetic flux sensor according to an embodiment.

Next, descriptions are given below of an internal structure of the magnetic flux sensor 204 according to the present embodiment with reference to FIG. 5. The magnetic flux sensor 204 is an oscillator circuit based on a Colpitts-type LC oscillator circuit (L represents a inductor and C represents a capacitor) and includes a coil pattern 11, a resistor pattern 12, first and second capacitors 13 and 14, a feedback resistor 15, unbuffered integrated circuits (ICs) 16 and 17, and an output terminal 18.

The coil pattern 11 is a planar coil made from a conducting wire (signal wire) printed on a board 300 (illustrated in FIG. 7) of the magnetic flux sensor 204. As illustrated in FIG. 5, the coil pattern 11 has an inductance L attained by the coil. In the coil pattern 11, the inductance L changes depending on the magnetic flux passing through a space opposing a board face on which the coil pattern 11 is printed. The magnetic flux sensor 204 in the present embodiment is used as a signal generator to output signals having a frequency corresponding to the magnetic flux passing through the space opposed to the face hearing the coil pattern 11.

Similar to the coil pattern 11, the resistor pattern 12 is a planar resistor made of a planar pattern of a conducting wire printed on the board 300. The resistor pattern 12 in the present embodiment has a serpentine or zigzag pattern, thereby better inhibiting flow of electrical current compared with a resistor having a linear pattern. Incorporating the resistor pattern 12 is one aspect of the present embodiment. The term "zigzag" means the shape in which the wire is bent and folded back, like a serpentine, multiple times to reciprocate in a predetermined direction. Referring to FIG. 5, the resistor pattern 12 has a resistance value $R_P$. The coil pattern 11 and the resistor pattern 12 are connected in series with each other.

The first and second capacitors 13 and 14 serve as a capacitance and a part of the Colpitts-type LC oscillator circuit including the coil pattern 11. Accordingly, the first and second capacitors 13 and 14 are connected serially with the coil pattern 11 and the resistor pattern 12. A loop including the coil pattern 11, the resistor pattern 12, and the first and second capacitors 13 and 14 serves as a resonance current loop.

The feedback resistor 15 is inserted to stabilize a bias voltage. With a function of the unbuffered ICs 16 and 17, fluctuations in potential of a part of the resonance current loop are output as a rectangular wave corresponding to the resonance frequency from the output terminal 18.

With this configuration, the magnetic flux sensor 204 oscillates at a frequency f corresponding to the inductance L, the resistance value $R_P$, and a capacitance C of the first and second capacitors 13 and 14. The frequency f is expressed by Formula 1 below.

$$f = \frac{1}{2\pi}\sqrt{\frac{1}{LC} - \left(\frac{R_L + R_P}{2L}\right)^2} \qquad \text{Formula 1}$$

The inductance L changes depending on the presence and density of the magnetic material adjacent to the coil pattern 11 (planar coil). Thus, according to the oscillation frequency of the magnetic flux sensor 204, the magnetic permeability in the space adjacent to the coil pattern 11 can be determined. As described above, the magnetic flux sensor 204 faces the vibration plate 201 via the casing 93*b* of the sub-hopper 90 in the present embodiment. Accordingly, the magnetic flux generated by the coil pattern 11 passes through the vibration plate 201. That is, the vibration plate 201 affects the magnetic flux generated by the coil pattern 11 and affects the inductance L. Consequently, the vibration plate 201 affects the frequency of signal of the magnetic flux sensor 204.

Figure 6:
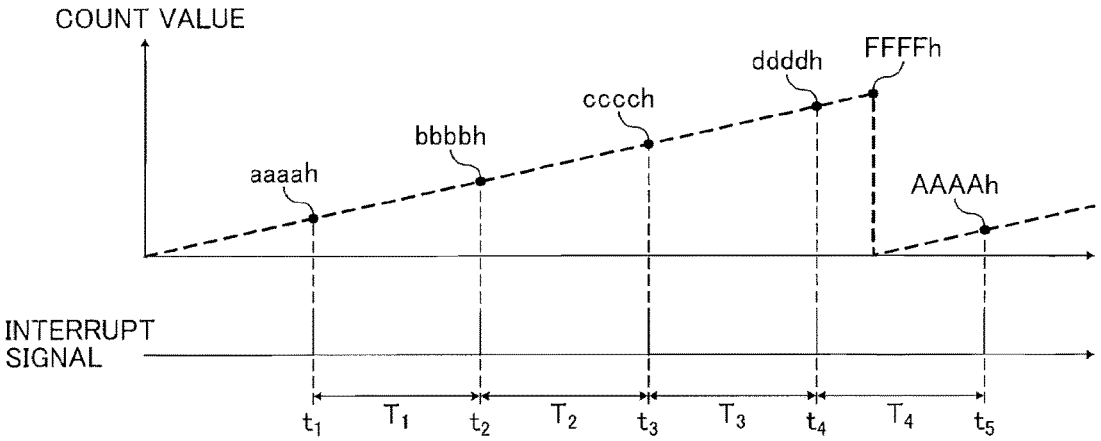
FIG. 6 is a chart of counting of a signal output from the magnetic flux sensor illustrated in FIG. 5.

FIG. 6 is a chart of counting of signal output from the magnetic flux sensor 204 according to the present embodiment. If the magnetic flux generated by the coil pattern 11 does not change, the magnetic flux sensor 204 keeps oscillating at a constant frequency basically. Consequently, the count value of the output signal increases constantly with elapse of time as illustrated in FIG. 6. For example, in FIG. 6, at time points $t_1$, $t_2$, $t_3$, $t_4$, and $t_5$, count values aaaah, bbbbh, cccch, ddddh, and AAAAh are acquired respectively.

The count values are calculated based on Periods $T_1$, $T_2$, $T_3$, and $T_4$ . . . in FIG. 6, respectively, to obtain the frequency in each of Periods $T_1$, $T_2$, $T_3$, and $T_4$ in FIG. 6. For example, in a case where an interrupt signal is output each time a reference clock equivalent for 2 milliseconds (ms) is counted, the count value in each of Periods $T_1$, $T_2$, $T_3$, and $T_4$ illustrated in FIG. 6 is divided with 2 (ms), thereby calculating the frequency f (Hz) of the magnetic flux sensor 204 in each period. In the case where the upper limit of the count value is FFFFh as in FIG. 6, the oscillation frequency f (Hz) in Period $T_4$ can be calculated as follows. Deduct ddddh from FFFFh and divide, with 2 (ms), the sum of the AAAAh and FFFFh−ddddh.

Thus, the image forming apparatus 100 according to the present embodiment acquires the frequency of signal generated by the magnetic flux sensor 204 and determines, based on the result of acquisition, a phenomenon corresponding to the oscillation frequency of the magnetic flux sensor 204. In the magnetic flux sensor 204 according to the present embodiment, the inductance L changes in response to the state of the vibration plate 201 disposed facing the coil pattern 11, and the frequency of signal output from the output terminal 18 changes accordingly. Consequently, a controller 20 (in FIG. 8) to acquire the signal recognizes the state of the vibration plate 201 disposed facing the coil pattern 11. The controller 20 determines the state of developer inside the sub-hopper 90 based on the state of the vibration plate 201. It is to be noted that, although the frequency is obtained by dividing the count value of the signal by the period in the description above, alternatively, in a case where the period during which the count value is acquired is fixed, the acquired count value itself can be used as the parameter indicating the frequency.

Figure 7:
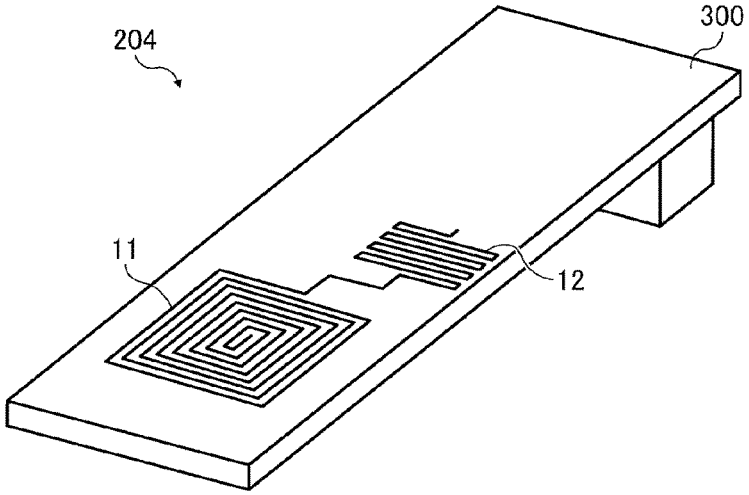
FIG. 7 is a perspective view illustrating an exterior of the magnetic flux sensor illustrated in FIG. 5.

FIG. 7 is a perspective view illustrating an exterior of the magnetic flux sensor 204 according to the present embodiment. In FIG. 7, the face of the board 300 on which the coil pattern 11 and the resistor pattern 12 are disposed is faced up. That is, a detection face for detecting magnetic permeability, which is to oppose the space subjected to magnetic permeability detection, is faced up. As illustrated in FIG. 7, the resistor pattern 12, which is connected serially to the coil pattern 11, is printed on the detection face on which the coil pattern 11 is printed. As described above with reference to FIG. 5, the coil pattern 11 is made of conducting wire (signal line) printed in a spiral shape on the board face. Additionally, the resistor pattern 12 is made of conducting wire printed in a serpentine or zigzag pattern on the board face, and the above-described function of the magnetic flux sensor 204 is established by these patterns. The coil pattern 11 and the resistor pattern 12 serves as a detecting portion of the magnetic flux sensor 204 according to the present embodiment. The magnetic flux sensor 204 is attached to the sub-hopper 90 with the detecting portion facing the vibration plate 201.

Figure 8:
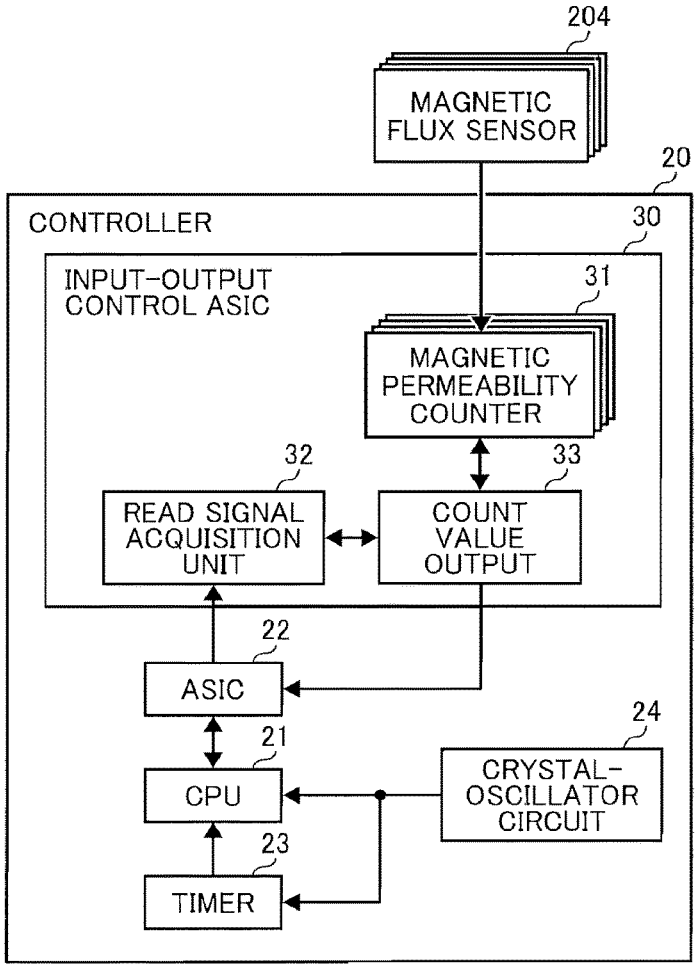
FIG. 8 is a schematic block diagram of a controller according to an embodiment, to acquire the signal from the magnetic flux sensor.

Next, descriptions are given below of a structure to acquire outputs from the magnetic flux sensor 204 in the image forming apparatus 100 according to the present embodiment, with reference to FIG. 8. FIG. 8 is a schematic block diagram of the controller to acquire the signal from the magnetic flux sensor 204. The controller 20 includes a central processing unit (CPU) 21, an application specific integrated circuit (ASIC) 22, a timer 23, a crystal-oscillator circuit 24, and an input-output control ASIC 30.

The CPU 21 is a computation unit and executes computation according to programs stored in a memory, such as a read only memory (ROM), to control operation of the entire controller 20. The ASIC 22 functions as a connection interface between a system bus, to which the CPU 21 and a random access memory (RAM) are connected, and another device. The timer 23 outputs an interrupt signal to the CPU 21 each time the count of reference clock input from the crystal-oscillator circuit 24 reaches a predetermined count. In response to the interrupt signal input from the timer 23, the CPU 21 outputs the read signal for acquiring the output value of the magnetic flux sensor 204. The crystal-oscillator circuit 24 generates the reference clock to operate respective elements inside the controller 20. The input-output control ASIC 30 acquires the signal output from the magnetic flux sensor 204 and converts the signals into data processable inside the controller 20. As illustrated in FIG. 8, the input-output control ASIC 30 includes a magnetic permeability counter 31, a read signal acquisition unit 32, and a count value output 33. As described above, the magnetic flux sensor 204 according to the present embodiment is an oscillator circuit that outputs a rectangular wave having the frequency corresponding to the magnetic permeability of the space as a detection target.

The magnetic permeability counter 31 increments the value according to the rectangular wave output from the magnetic flux sensor 204. That is, the magnetic permeability counter 31 serves as a target signal counter to count the number of the signal whose frequency is to be calculated. It is to be noted that, in the present embodiment, multiple magnetic flux sensors 204 are provided for the respective sub-hoppers 90 connected to developing devices 112Y, 112M, 112C, and 112K, and multiple magnetic permeability counters 31 are used accordingly. The read signal acquisition unit 32 acquires, from the CPU 21 via the ASIC 22, the read signal, which is a command to acquire the count value of the magnetic permeability counter 31. Acquiring the read signal from the CPU 21, the read signal acquisition unit 32 inputs, to the count value output 33, a signal instructing output of the count value. According to the signal from the read signal acquisition unit 32, the count value output 33 outputs the count value of the magnetic permeability counter 31.

It is to be noted that the CPU 21 has an access to the input-output control ASIC 30, for example, via a register. Accordingly, the CPU 21 writes a value in a predetermined register of in the input-output control ASIC 30 to output the above-described read signal. Additionally, the count value from the count value output 33 is stored in a predetermined register of the input-output control ASIC 30, from which the CPU 21 acquires the count value. The controller 20 illustrated in FIG. 8 is disposed in an apparatus (e.g., the image forming apparatus 100) or a device other than the magnetic flux sensor 204 in one embodiment. In another embodiment, the controller 20 is mounted, as a circuit including the CPU 21, on the board 300 of the magnetic flux sensor 204.

In the above-described structure, the CPU 21 detects the vibration state of the vibration plate 201 based on the count value acquired from the count value output 33 and, based on the detection result, detects the amount of developer in the sub-hopper 90. The count value output 33 serves as a frequency-related data output. That is, a detection result processor is implemented by the CPU 21 performing computation according to a predetermined program. The count value acquired from the count value output 33 is used as frequency-related data indicating the frequency of the magnetic flux sensor 204, which changes corresponding to the vibration of the vibration plate 201.

Figure 9:
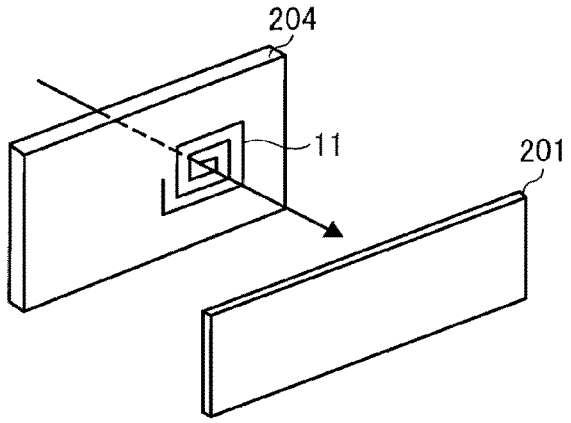
FIG. 9 illustrates relative positions of the magnetic flux sensor and a vibration plate, according to an embodiment.

Next, descriptions are given below of effects of the vibration plate 201 on the oscillation frequency of the magnetic flux sensor 204 according to the present embodiment. As illustrated in FIG. 9, the board face of the magnetic flux sensor 204 bearing the coil pattern 11 faces the vibration plate 201 via the casing 93*b* of the sub-hopper 90. Then, a magnetic flux arises, centering around a center of the coil pattern 11, and the magnetic flux penetrates the vibration plate 201.

Figure 10:
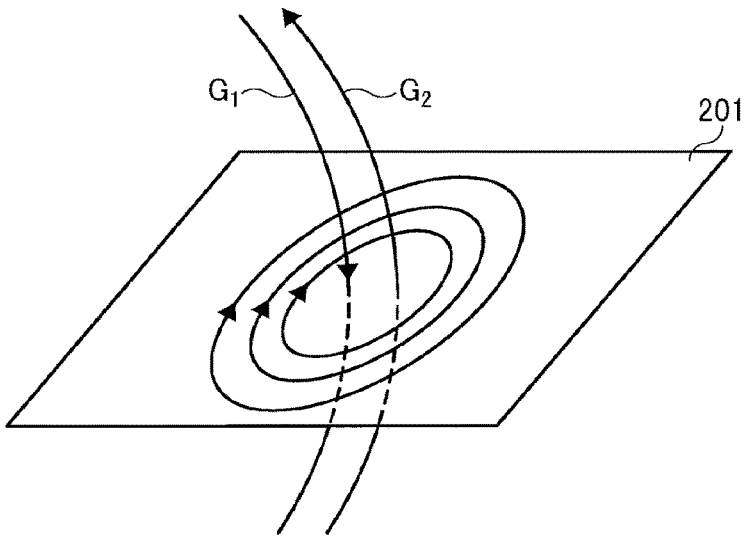
FIG. 10 illustrates actions of magnetic flux penetrating the vibration plate illustrated in FIG. 9.

For example, the vibration plate 201 is made of a stainless steel plate. As illustrated in FIG. 10, an eddy current is generated in the vibration plate 201 as a magnetic flux $G_1$ penetrates the vibration plate 201. A magnetic flux $G_2$ is generated by the eddy current and acts to cancel the magnetic flux $G_1$ generated by the coil pattern 11. As the magnetic flux $G_1$ is thus canceled, the inductance L in the magnetic flux sensor 204 decreases. As defined by Formula 1 above, the oscillation frequency f increases as the inductance L decreases.

Figure 11:
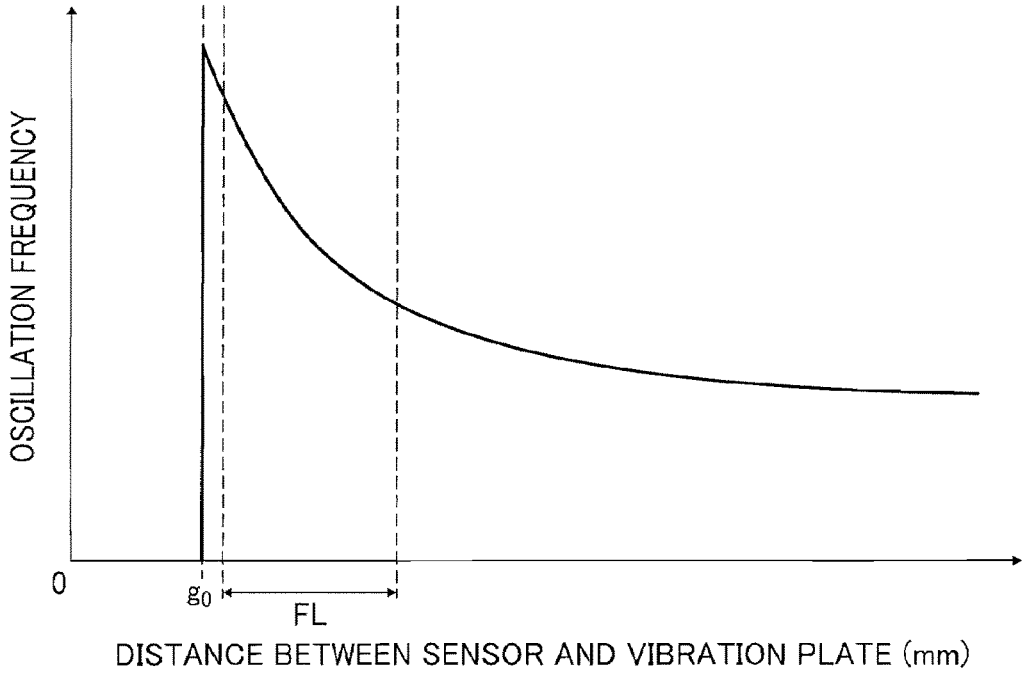
FIG. 11 is a graph of oscillation frequency of the magnetic flux sensor corresponding to a distance between the magnetic flux sensor and the vibration plate.

The strength of the eddy current, which occurs inside the vibration plate 201 due to the magnetic flux generated by the coil pattern 11, changes according to the strength of the magnetic flux as well as a distance between the coil pattern 11 and the vibration plate 201. FIG. 11 is a graph of oscillation frequency of the magnetic flux sensor 204 corresponding to the distance between the coil pattern 11 and the vibration plate 201. The strength of the eddy current occurring inside the vibration plate 201 is inversely proportional to the distance between the coil pattern 11 and the vibration plate 201. Accordingly, as the distance between the coil pattern 11 and the vibration plate 201 decreases, the oscillation frequency of the magnetic flux sensor 204 becomes higher. When the distance is smaller than a threshold, the inductance L is too low, and the magnetic flux sensor 204 does not oscillate. Therefore, the oscillation frequency is zero in a period till a time point g0 in FIG. 11.

In the sub-hopper 90 according to the present embodiment, the CPU 21 uses the characteristics illustrated in FIG. 11 to detect the vibration of the vibration plate 201 based on the oscillation frequency of the magnetic flux sensor 204. The amount of developer in the sub-hopper 90 is detected based on the vibration of the vibration plate 201 thus detected. In other words, the vibration plate 201 and the magnetic flux sensor 204 illustrated in FIG. 9 as well as the structure to process the signal output from the magnetic flux sensor 204 is used as a powder detector according to the present embodiment. The magnetic flux sensor 204 serves as a vibration detector.

The vibration of the vibration plate 201 flipped by the torsion spring 203 is expressed by an eigenfrequency and an attenuation ratio determined by external factors that absorb the vibration energy. The eigenfrequency is defined by rigidity of the vibration plate 201 and weight of the projection 202. The external factors to absorb the vibration energy include the presence of developer that contacts the vibration plate 201 in the sub-hopper 90, in addition to fixed factors such as the holding strength of a mount 201*a* cantilevering the vibration plate 201 and air resistance. The amount or state of developer that contacts the vibration plate 201 in the sub-hopper 90 changes depending on the amount of developer in the sub-hopper 90. Accordingly, detection of the vibration of the vibration plate 201 enables the detection of developer amount in the sub-hopper 90. In the sub-hopper 90 according to the present embodiment, the torsion spring 203, disposed on the first stirring conveyor 96 to stir developer, flips the vibration plate 201 and vibrates the vibration plate 201 periodically according to the rotation cycle.

Next, descriptions are given below of placement of components around the vibration plate 201 in the sub-hopper 90 and the structure for the torsion spring 203 to flip the vibration plate 201.

Figure 12:
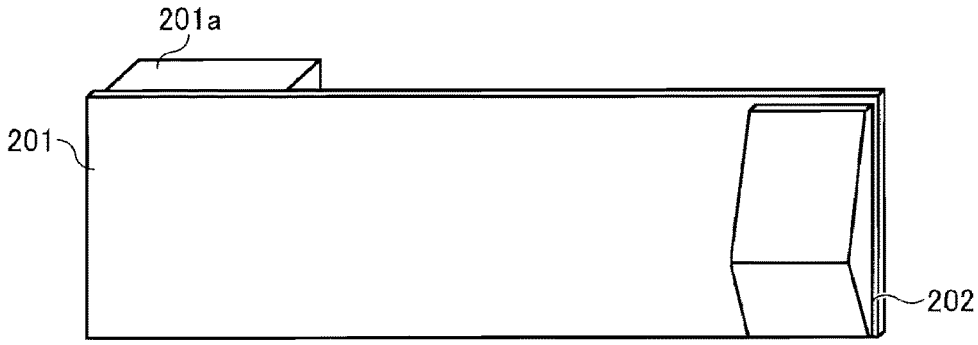
FIG. 12 is a perspective view illustrating a component layout around the vibration plate illustrated in FIG. 9.
Figure 13:
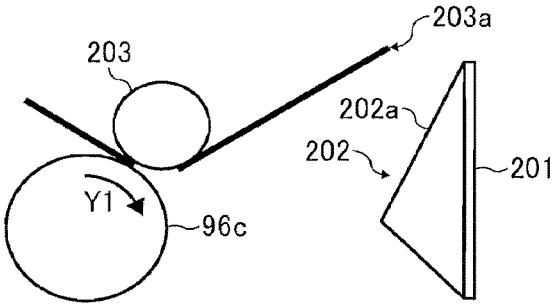
FIG. 13 is a side view illustrating a rotation position of the rotation shaft, at which the torsion spring is about to contact a projection on the vibration plate illustrated in FIG. 12.

FIG. 12 is a perspective view illustrating a component layout around the vibration plate 201. As illustrated in FIG. 12, the vibration plate 201 is secured via the mount 201*a* to the casing 93*b* of the sub-hopper 90. FIG. 13 is a side view illustrating a rotation position of the rotation shaft 96*c*, at which the torsion spring 203 is about to contact the projection 202. Specifically, the portion of the torsion spring 203 that contacts the projection 202 is referred to as a contact portion 203*a*. The rotation shaft 96*c* rotates so that the torsion spring 203 rotates clockwise in FIG. 13. The torsion spring 203 is an elastic body attached to the rotation shaft 96*c* via a holder 205 (illustrated in FIG. 22A). The torsion spring 203 is constantly biased in the direction in which the rotation shaft 96*c* rotates (clockwise in FIG. 13).

As illustrated in FIG. 13, the projection 202 projects from a face (on the front side of paper on which FIG. 13 is drawn) of the vibration plate 201 and inclined relative to the face of the vibration plate 201 when viewed from a side (from the right in FIG. 12). Specifically, the projection 202 has a first inclined face 202*a* that approaches the rotation shaft 96*c* along the rotation direction of the torsion spring 203. That is, first inclined face 202*a* is inclined to increase the projecting amount of the projection 202 in the rotation direction of the torsion spring 203. When the torsion spring 203 flips the vibration plate 201 to vibrate, the contact portion 203*a* of the torsion spring 203 pushes the first inclined face 202*a* of the projection 202.

Figure 14:
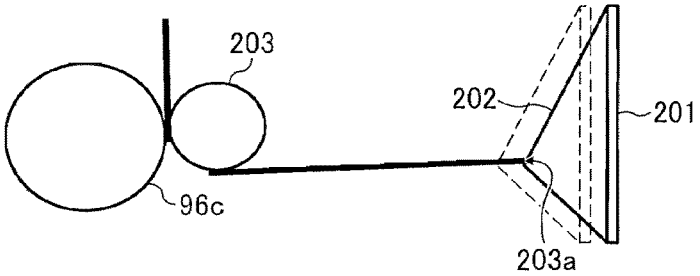
FIG. 14 is a side view of the torsion spring rotated further from the position illustrated in FIG. 13.

FIG. 14 is a side view of the torsion spring 203 positioned downstream in the direction indicated by arrow Y1 from the position illustrated in FIG. 13. As the torsion spring 203 rotates further with the contact portion 203*a* kept in contact with the projection 202, the vibration plate 201 is pushed and deformed along the first inclined face 202*a*. In FIG. 14, broken lines represent positions of the vibration plate 201 and the projection 202 in a state in which no external force is applied thereto (hereinafter "stationary state"). As illustrated in FIG. 14, the contact portion 203*a* of the torsion spring 203 pushes the projection 202 on the vibration plate 201.

Since the vibration plate 201 is secured via the mount 201*a* to the inner wall of the casing 93*b* of the sub-hopper 90, the position of one end of the vibration plate 201 secured to the mount 201*a* does not change. By contrast, the opposite end (i.e., a free end) of the vibration plate 201, in which the projection 202 is disposed, is pushed by the torsion spring 203 and moves to the side opposite to the rotation shaft 96*c*. Consequently, the vibration plate 201 deforms, starting from the mount 201*a*. Energy to vibrate the vibration plate 201 is accumulated in the vibration plate 201 being in the deformed state.

Figure 15:
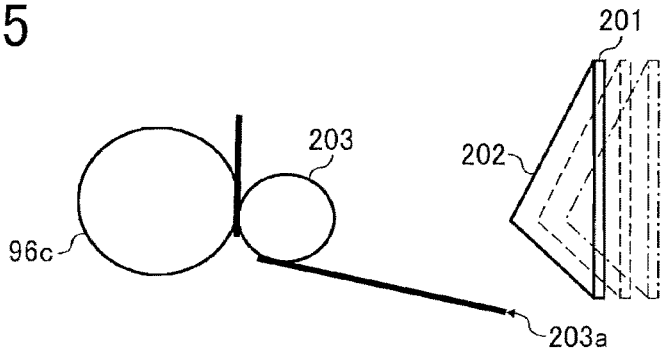
FIG. 15 is a side view of the torsion spring rotated further from the position illustrated in FIG. 14.
Figure 16:
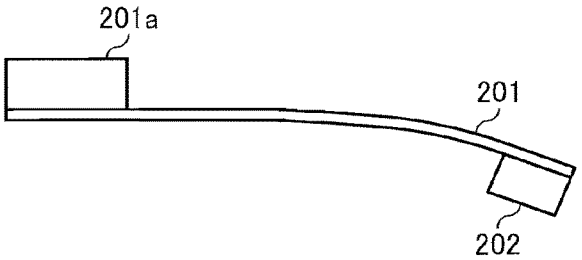
FIG. 16 is a top view of the vibration plate illustrated in FIG. 15.

FIG. 15 is a side view of the torsion spring 203, in which the torsion spring 203 is positioned downstream in the direction indicated by arrow Y1 from the position illustrated in FIG. 14. In FIG. 15, broken lines represents the position (i.e., a predetermined position) of the vibration plate 201 being in the stationary state, and alternate long and short dashed lines represent the position of the vibration plate 201 illustrated in FIG. 14. When the vibration energy, which has been accumulated by the contact portion 203*a* of the torsion spring 203 pushing the vibration plate 201, is released, the vibration plate 201 deforms to the opposite side as represented by solid lines. FIG. 16 is a top view of the vibration plate 201. As illustrated in FIG. 15, when the pushing force given to the projection 202 by the torsion spring 203 is released, owing to the energy of deformation accumulated in the vibration plate 201, the free end of the vibration plate 201, provided with the projection 202, deforms and moves to the opposite side. In the state illustrated in FIGS. 15 and 16, the vibration plate 201 is away from the magnetic flux sensor 204, which faces the vibration plate 201 via the casing 93*b* of the sub-hopper 90. Subsequently, while the vibration plate 201 repeatedly vibrate to approach the magnetic flux sensor 204, beyond the predetermined position in the stationary state, and draw away from the magnetic flux sensor 204 further from the predetermined position, the vibration plate 201 returns to the predetermined position as the vibration attenuates.

Figure 17:
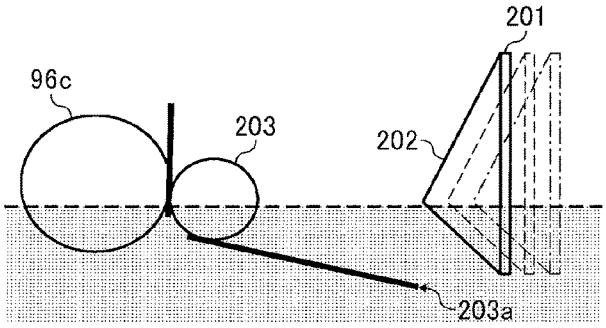
FIG. 17 schematically illustrates a state of developer, which is represented by dots, stored in the sub-hopper.

FIG. 17 schematically illustrates a state of developer (represented by dots) stored in the sub-hopper 90. When the developer is present in the sub-hopper 90 as illustrated in FIG. 17, the vibration plate 201 and the projection 202 contact the developer while vibrating. Accordingly, compared with a state in which the sub-hopper 90 is empty, the vibration of the vibration plate 201 attenuates early. According to changes in attenuation of vibration, the amount of developer in the sub-hopper 90 is detected.

Figure 18:
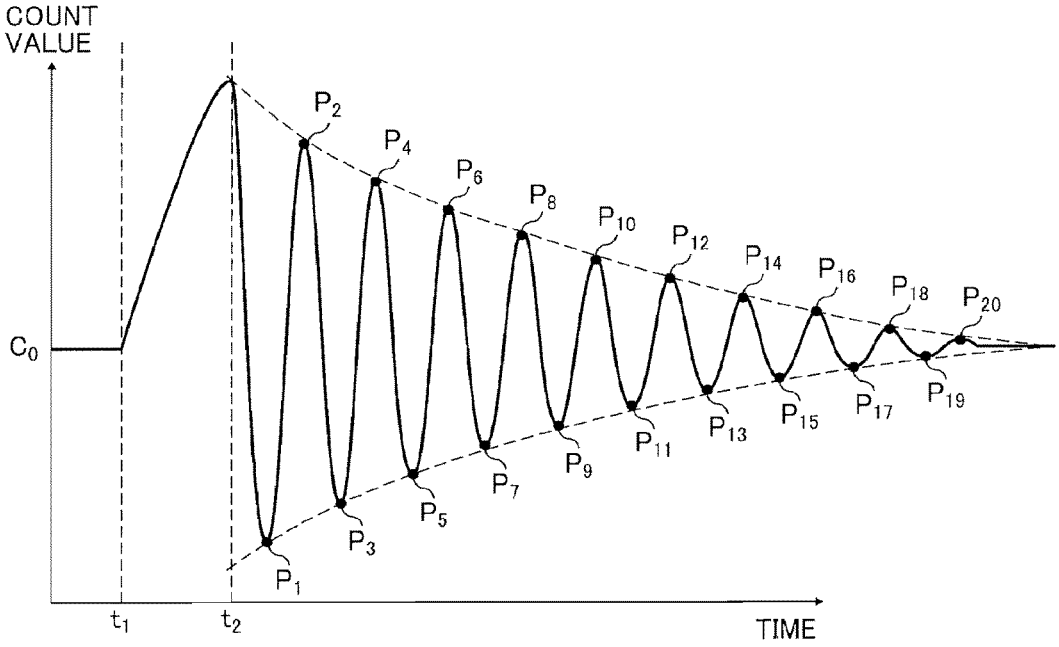
FIG. 18 is a graph of changes in the count of the oscillation signal from the magnetic flux sensor from when the torsion spring flips the projection until the vibration of the vibration plate ceases.

FIG. 18 is a graph of changes in the count value of the oscillation signal from the magnetic flux sensor 204 per counting period from when the torsion spring 203 flips the projection 202 until the vibration of the vibration plate 201 attenuates to cease. Reference $C_0$ represents the count value at a neutral state.

The count value of the oscillation signal from the magnetic flux sensor 204 increases as the oscillation frequency becomes higher. Accordingly, the count value indicated by the ordinate in FIG. 18 is replaceable with the oscillation frequency. As illustrated in FIG. 18, at Time point $t_1$, the contact portion 203*a* of the torsion spring 203 contacts and pushes the projection 202, and the vibration plate 201 approaches the magnetic flux sensor 204. Then, the oscillation frequency of the magnetic flux sensor 204 increases, and the count value per counting period increases. At Time point $t_2$, the torsion spring 203 stops pushing the projection 202. Subsequently, the vibration plate 201 vibrates owing to the accumulated vibration energy. As the vibration plate 201 vibrates, the distance to the magnetic flux sensor 204 repeatedly increases and decreases from the distance between the predetermined position of the vibration plate 201 and the magnetic flux sensor 204 in the stationary state. Consequently, the frequency of the oscillation signal of the magnetic flux sensor 204 fluctuates inherent to the vibration of the vibration plate 201, and the count value per counting period fluctuates similarly.

The amplitude of vibration of the vibration plate 201 becomes narrower as the vibration energy is consumed. That is, the vibration of the vibration plate 201 attenuates with elapse of time. Accordingly, the change in distance between the vibration plate 201 and the magnetic flux sensor 204 decreases with elapse of time. Similarly, the change in count value changes with elapse of time. As described above, the vibration of the vibration plate 201 attenuates earlier when the amount of developer remaining in the sub-hopper 90 is greater. Accordingly, how the vibration of the vibration plate 201 attenuates is recognizable based on the analysis of the attenuation manner of the oscillation signal from the magnetic flux sensor 204 illustrated in FIG. 18. Then, the amount of developer in the sub-hopper 90 is recognizable. Referring to FIG. 18, when $P_1$, $P_2$, $P_3$, $P_4$ . . . represent the peaks of the count values of the oscillation signal, respectively, an attenuation ratio ζ of the vibration of the vibration plate 201 can be obtained by, for example, Formula 2 below.

$$\zeta = \frac{P_6 - P_5}{P_2 - P_1} \qquad \text{Formula 2}$$

Referring to the change ratio between one peak value and another peak value acquired at different time points as expressed by Formula 2, errors caused by environmental changes are canceled, thereby attaining more accurate attenuation ratio. Specifically, in Formula 2, the ratio between the difference between $P_2$ and $P_1$, and the difference between $P_6$ and $P_5$ is calculated. In other words, the CPU 21 (illustrated in FIG. 8) according to the present embodiment obtains the attenuation ratio ζ based on the ratio of the count values acquired at different time points.

It is to be noted that, in Formula 2, use of Peaks $P_1$ and $P_2$, and Peaks $P_5$ and $P_6$, out of the peaks illustrated in FIG. 18, is an example, and other peaks can be used instead. However, it is preferable to exclude the peak at Time point $t_2$, at which the vibration plate 201 pushed by the torsion spring 203 is closest to the magnetic flux sensor 204, since the peak at Time point $t_2$ includes error. For example, the friction between the torsion spring 203 and the projection 202 causes a sliding noise, which is superimposed on the peak. Even if the developer in the sub-hopper 90 accelerates the attenuation of the vibration, as illustrated in FIG. 17, the vibration frequency of the vibration plate 201 does not change significantly. Accordingly, the attenuation of amplitude in the specific period can be calculated from the calculated ratio of the amplitude of specific peaks as expressed in Formula 2.

Figures 19, 20:
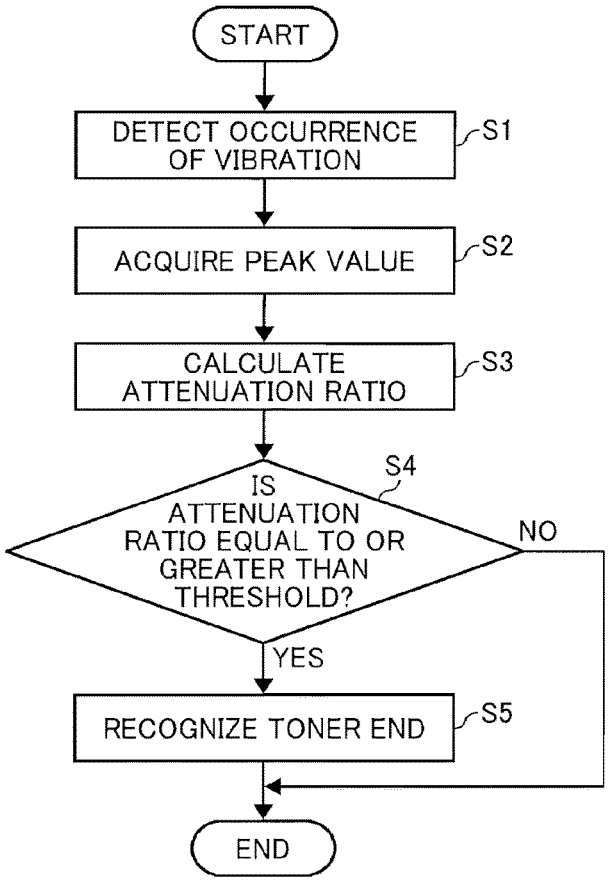
FIG. 19 is a flowchart of developer amount detection in the sub-hopper, according to an embodiment.
FIG. 20 is a table of data in count value analysis according to an embodiment.

Next, descriptions are given below of detection of developer amount in the sub-hopper 90 according to the present embodiment with reference to a flowchart illustrated in FIG. 19. FIG. 19 illustrates a flow of actions of the CPU 21 illustrated in FIG. 8. As illustrated in FIG. 19, at S1, the CPU 21 detects the occurrence of vibration as the torsion spring 203 pushes the projection 202 as illustrated in FIG. 14. As described above, the CPU 21 acquires, from the count value output 33, the count value of the signal output from the magnetic flux sensor 204 per counting period. In the stationary state, the count value is $C_0$ as illustrated in FIG. 18. By contrast, as the projection 202 is pushed as illustrated in FIG. 14 and the vibration plate 201 approaches the magnetic flux sensor 204 accordingly, the count value increases. Accordingly, at S1, the CPU 21 detects the occurrence of vibration when the count value acquired from the count value output 33 exceeds a threshold.

Regardless of step S1, the CPU 21 keeps acquiring the count value per counting period. At S2, the CPU 21 acquires the peak value of fluctuation of the count value, which accords with the vibration of the vibration plate 201 illustrated in FIG. 18. The CPU 21 analyzes the count value continuously acquired per counting period, thereby identifying the peak value.

FIG. 20 is a table of data of count analysis. The data in FIG. 20 include "number n", "count value $S_n$" acquired in each counting period, and the sign (+ or −) of the difference ($S_{n-1}-S_n$) between each count value $S_n$ and the immediately preceding count value $S_{n-1}$. The "number n", "count value $S_n$", and the sign (+ or −) are arranged in the order of acquisition. In the data illustrated in FIG. 20, the peak is immediately before the sing of "$S_{n-1}-S_n$" is inverted. In the case illustrated in FIG. 20, "5" and "10" are adopted as peaks. That is, subsequent to S1, the CPU 21 calculates "$S_{n-1}-S_n$" in FIG. 20 regarding the count values sequentially acquired. The count value $S_n$ of the number n immediately before the sign of "$S_{n-1}-S_n$" is inverted is adopted as $P_1$, $P_2$, $P_3$ . . . illustrated in FIG. 18.

As described above, the count value at Timing $t_2$, which is an initial peak after the step S1, is preferably avoided. Accordingly, the CPU 21 discards the initial peak out of the extracted peaks through the analysis illustrated in FIG. 20. Additionally, in practice, it is possible that the count value include noise of high frequency component, and the sign of "$S_{n-1}-S_n$" may be inverted at a timing different from the timing at which the vibration of the vibration plate 201 is at the peak. To avoid erroneous detection in such cases, it is preferred that, before analyzing the values as illustrated in FIG. 20, the CPU 21 smooth the values acquired from the count value output 33. The acquired values can be smoothed through common methods such as moving average.

Using the peak values thus obtained, at S3, the CPU 21 calculates the attenuation ratio ζ according to Formula 2 mentioned above. Accordingly, at S2, the CPU 21 continues the count value analysis illustrated in FIG. 20 until the peak values used in the attenuation ratio calculation are attained. In the case of Formula 2, the CPU 21 analyzes the count values until the peak value equivalent to Peak $P_6$ is attained.

At S4, the CPU 21 determines whether the attenuation ratio ζ calculated at S3 is equal to or smaller than the threshold. In other words, the CPU 21 determined whether the amount of developer in the sub-hopper 90 is below the predetermined amount based on the comparison between the rate of the count values acquired at different time points and the threshold. As described above with reference to FIG. 17, when a sufficient amount of developer is in the sub-hopper 90, the vibration of the vibration plate 201 attenuates early, and the attenuation ratio ζ is smaller.

As the amount of developer in the sub-hopper 90 decreases, the attenuation of the vibration of the vibration plate 201 is slowed, and the attenuation ratio ζ increases. Accordingly, when the threshold is set to the attenuation ratio $\zeta_s$ corresponding to the amount of remaining developer to be detected, whether the amount of developer remaining in the sub-hopper 90 falls to the amount to be detected (hereinafter "prescribed amount") can be determined based on the calculated attenuation ratio ζ.

It is to be noted that the amount of developer in the sub-hopper 90 does not directly affect the attenuation manner of vibration of the vibration plate 201. According to the amount of remaining developer, the manner of contact of developer with the vibration plate 201 changes, and the manner of contact defines the manner of attenuation of vibration of the vibration plate 201. Therefore, even if the amount of developer in the sub-hopper 90 is the same, the vibration of the vibration plate 201 attenuates differently if the manner of contact between the vibration plate 201 and developer is different. By contrast, in the present embodiment, the torsion spring 203 constantly stirs the developer in the sub-hopper 90, in detection of developer amount in the sub-hopper 90. Accordingly, to a certain degree, the state of contact of developer with the vibration plate 201 is determined with the amount of remaining developer. This configuration can avoid the inconvenience that the detection result differs depending on the manner of contact between the vibration plate 201 and developer even if the remaining amount is the same.

When the CPU 21 determines that the calculated attenuation ratio ζ is below the threshold (No at S4), the CPU 21 determines that the amount of developer in the sub-hopper 90 is equal to or greater than the prescribed amount and completes the processing. By contrast, when the calculated attenuation ratio ζ is equal to or greater than the threshold (Yes at S4), the CPU 21 determines that the amount of developer in the sub-hopper 90 is below the prescribed amount and, at S5, detects the developer end in the sub-hopper 90. Then, the processing is completed. Detecting the developer end at S5, the CPU 21 outputs a signal indicating that the amount of remaining developer is below the prescribed amount, to an upper level controller to control the image forming apparatus 100. With this signal, the controller of the image forming apparatus 100 recognizes the end of developer of specific color and becomes capable of supplying developer from the developer bottle 117.

Figure 21:
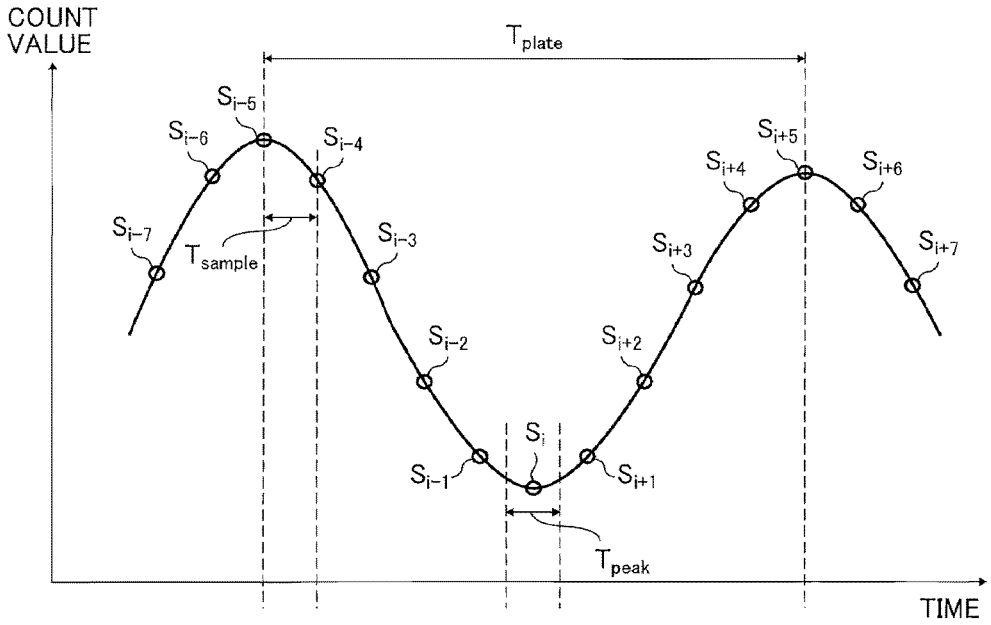
FIG. 21 is a chart of count values sampled during a single vibration cycle of the vibration plate.

Next, descriptions are given below of the relation between the oscillation frequency of the magnetic flux sensor 204, the cycle in which the CPU 21 acquires the count values (hereinafter "sampling cycle"), and the eigenfrequency of the vibration plate 201. FIG. 21 is a chart of count values sampled during a single vibration cycle of the vibration plate 201. In FIG. 21, the vibration cycle of the vibration plate 201 is represented by "$T_{plate}$", and the sampling cycle is represented by "$T_{sample}$".

To calculate, at a higher degree of accuracy, the attenuation ratio ζ of the vibration of the vibration plate 201 through the method illustrated in FIGS. 18 through 20, it is necessary to acquire the peak value of vibration of the vibration plate 201 accurately. For that, it is preferred that the number of sampled count values in the vibration cycle $T_{plate}$ be sufficient, and the sampling cycle $T_{sample}$ be small enough relative to the vibration cycle $T_{plate}$.

In the case illustrated in FIG. 21, the number of count values sampled in one vibration cycle $T_{plate}$ is 10. That is, the sampling cycle $T_{sample}$ is 1/10 of the vibration cycle T. In the case illustrated in FIG. 21, the count value $S_i$ is inevitably sampled during a peak period $T_{peak}$ of the count value, and thus the peak value can be acquired with a higher degree of accuracy.

Accordingly, for example, when the sampling cycle $T_{sample}$ for the CPU 21 to acquire the count values is 1 ms, the vibration cycle $T_{plate}$ of the vibration plate 201 is preferably 10 ms or greater. In other words, regarding a sampling frequency 1000 Hz of the CPU 21, the eigenfrequency of the vibration plate 201 is preferably about 100 Hz and, more preferably, not greater than 100 Hz. Such an eigenfrequency of the vibration plate 201 is attained by adjusting the material of the vibration plate 201, the dimension (including thickness) of the vibration plate 201, and the weight of the projection 202.

By contrast, if the count value acquired per each sampling cycle is too small, changes in the sampled count values corresponding to the vibration of the vibration plate 201 are small, and it becomes difficult to accurately calculate the attenuation ratio ζ. Here, the count value sampled conforms to the oscillation frequency of the magnetic flux sensor 204. Typically, the oscillation frequency of the magnetic flux sensor 204 is of the order of several megahertz (MHz). When the sampling is performed at a sampling frequency of 1000 Hz, 1000 count values or greater are obtained at each sampling timing. According to the order of the vibration cycle $T_{plate}$ and the sampling cycle $T_{sample}$, the attenuation ratio ζ can be calculated accurately.

However, the amplitude of fluctuation of the count values relative to time illustrated in FIG. 18 is small if the change in the oscillation frequency of the magnetic flux sensor 204 is insufficient relative to the change in distance between the magnetic flux sensor 204 and the vibration plate 201. The change in distance therebetween is defined by the vibration of the vibration plate 201. As a result, the change in the attenuation ratio ζ also becomes smaller, thereby degrading the accuracy in detecting the amount of remaining developer, using the vibration of the vibration plate 201. To increase the change in oscillation frequency of the magnetic flux sensor 204 corresponding to the change in distance between the magnetic flux sensor 204 and the vibration plate 201, the distance therebetween is determined based on the characteristics illustrated in FIG. 11. For example, it is preferred that the distance between the magnetic flux sensor 204 and the vibration plate 201 (in the stationary state) be set to the distance that corresponds to the range in which the oscillation frequency changes steeply corresponding to the distance therebetween, such as a range FL in FIG. 11.

Figure 22A:
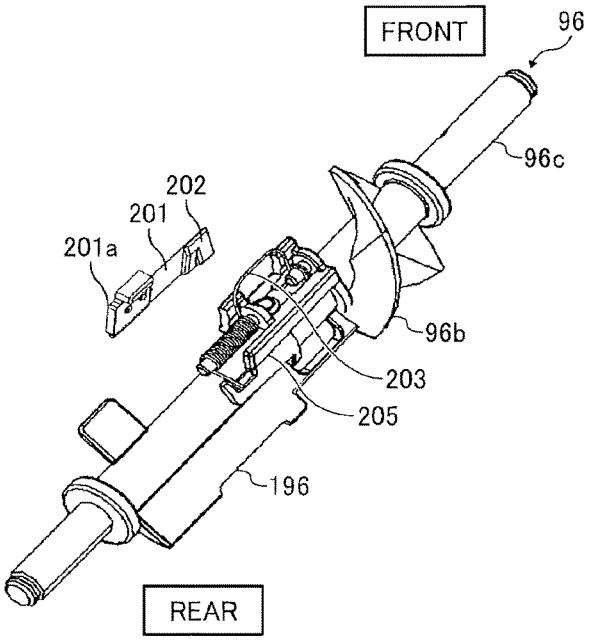
FIG. 22A is a perspective view of a structure to vibrate the vibration plate, according to Embodiment 1.
Figure 22B:
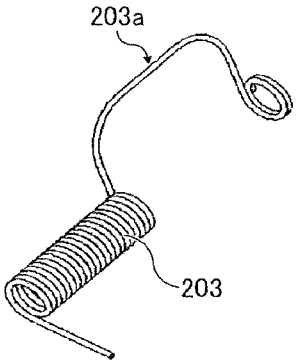
FIG. 22B is a perspective view of a torsion spring in the structure illustrated in FIG. 22A.

FIG. 22A is a perspective view of a structure to vibrate the vibration plate 201. FIG. 22B is a perspective view of the torsion spring 203.

In the present embodiment, the torsion spring 203 serves as the contact member to vibrate the vibration plate 201. The vibration plate 201 is secured to the casing 93*b* of the sub-hopper 90 via the mount 201*a*, which is disposed on one end of the vibration plate 201 in the direction parallel to the axial direction of the rotation shaft 96*c*. The projection 202 (i.e., a weight) that is triangular in cross section is disposed on the other end of the vibration plate 201. The projection 202 projects from the face of the vibration plate 201 facing the rotation shaft 96*c*. The projection 202 includes the first inclined face 202*a*, an apex 202*b*, and a second inclined face 202*c* arranged in that order in the direction indicated by arrow Y1 in FIG. 23, in which the rotation shaft 96*c* rotates. The first inclined face 202*a* is inclined to approach the rotation shaft 96*c* in the rotation direction of the rotation shaft 96*c*. The second inclined face 202*c* is inclined to draw away from the rotation shaft 96*c* in the rotation direction of the rotation shaft 96*c*. That is, the second inclined face 202*c* is inclined to reduce the projecting amount of the projection 202 in the rotation direction of the torsion spring 203. The first inclined face 202*a* and the second inclined face 202*c* are connected together at the apex 202*b*.

The torsion spring 203 is secured via the holder 205 to the rotation shaft 96*c* of the first stirring conveyor 96. As the rotation shaft 96*c* rotates, the torsion spring 203 rotates together with the rotation shaft 96*c*. As the torsion spring 203 rotates, the contact portion 203*a* thereof contacts the projection 202. Then, the torsion spring 203 pushes the projection 202 to the casing 93*b*, and the vibration plate 201 elastically deforms. As the torsion spring 203 rotates further from the position to push the projection 202, the contact portion 203*a* of the torsion spring 203 is disengaged from the projection 202, flipping the vibration plate 201. Then, the vibration plate 201 vibrates with the force to return to the predetermined position in the stationary state.

A preferable material for the torsion spring 203 is elastic wire made of, for example, hard drawn steel wire type C (SW-C), piano wire type A (SWP-A), piano wire type B (SWP-B), or stainless steel spring wire (SUS 304-WPB) according to Japanese Industrial Standards (JIS). However, the material for the torsion spring 203 is not limited thereto. Although the torsion spring 203 illustrated in FIG. 22B is a single torsion spring, in which a torsion coiled spring is disposed on one side, the shape of the torsion spring 203 is not limited thereto. For example, a double torsion spring can be used instead. The force with which the torsion spring 203 pushes the vibration plate 201 is adjustable with the material of the torsion spring 203 or the number of turns of the coiled portion thereof. Thus, the force of the torsion spring 203 to push the vibration plate 201 can be changed as required. For example, the force is changed between the case where one-component developer (i.e., toner) is used and the case where two-component developer is used. It is to be noted that the contact member to flip the vibration plate 201 is not limited to the torsion spring 203. For example, a wire piece or a rod can be used. This configuration can reduce the area of contact between the projection 202 of the vibration plate 201 and the contact member and accordingly inhibit toner aggregation.

Figure 23:
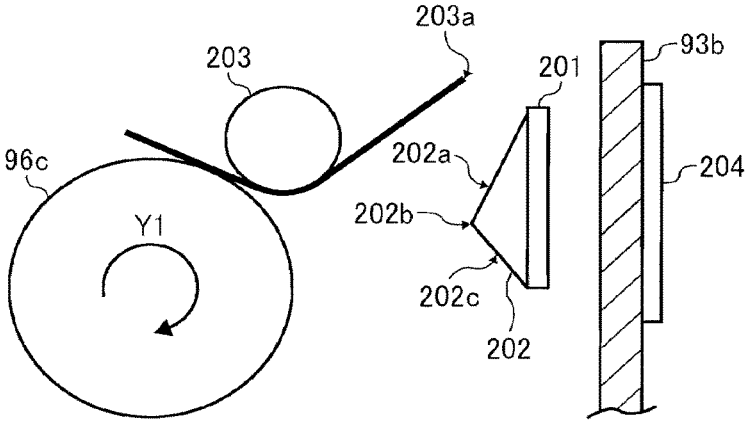
FIG. 23 is a schematic view illustrating a state before the torsion spring, which is attached via a holder to the rotation shaft, contacts the projection on the vibration plate in the structure illustrated in FIG. 22A.

FIG. 23 is a schematic view illustrating a state before the contact portion 203*a* of the torsion spring 203 contacts the projection 202 attached to the vibration plate 201. The torsion spring 203 is attached, via the holder 205, to the rotation shaft 96*c* of the first stirring conveyor 96. The torsion spring 203 rotates clockwise in FIG. 23, together with the rotation shaft 96*c* of the first stirring conveyor 96. The projection 202 attached to the vibration plate 201 includes the first inclined face 202*a* (i.e., an upstream inclined face), the apex 202*b*, and the second inclined face 202*c* (i.e., a downstream inclined face) disposed in the rotation direction of the torsion spring 203 (the rotation shaft 96*c*) indicated by arrow Y1. The first inclined face 202*a* is inclined to rise, from the face of the vibration plate 201 facing the rotation shaft 96*c*, in the rotation direction indicated by arrow Y1. The second inclined face 202*c* is inclined to descend, toward the face of the vibration plate 201 facing the rotation shaft 96*c*, in the rotation direction indicated by arrow Y1. At the apex 202*b* connecting the first inclined face 202*a* to the second inclined face 202*c*, the height of the projection 202 from the face of the vibration plate 201 facing the rotation shaft 96*c* is highest. It is to be noted that the shape of the apex 202*b* is not limited to a pointed shape but can be a rounded shape or a flat shape.

FIG. 1 is a schematic view illustrating a state in which the torsion spring 203 is positioned downstream in the clockwise direction in FIGS. 1 and 23 from the position illustrated in FIG. 23.

As illustrated in FIG. 1, as the torsion spring 203 rotates, the contact portion 203*a* contacts the first inclined face 202*a* of the projection 202 and moves on the first inclined face 202*a* to the apex 202*b*. Then, the torsion spring 203 pushes the vibration plate 201 to the casing 93*b*. While the torsion spring 203 pushes the projection 202 as the rotation shaft 96*c* rotates, the torsion coil spring is twisted. As the rotation shaft 96*c* rotates further, the contact portion 203*a* passes the apex 202*b* of the projection 202 and leaves the projection 202. Then, due to the force of the torsion coil spring, the contact portion 203*a* passes the second inclined face 202*c*, and the torsion spring 203 reverts to the shape indicated by broken lines in FIG. 1. As the contact portion 203*a* passes the apex 202*b* of the projection 202, the vibration plate 201, which has been pushed by the torsion spring 203, is flipped and vibrates to return to the position indicated by broken lines. Based on the vibration of the vibration plate 201 detected by the magnetic flux sensor 204, the CPU 21 detects the amount of developer.

When the torsion spring 203 is used as the contact member to flip the vibration plate 201, the strength and the durability are higher compared with an elastic sheet such as Mylar (registered trademark of DuPont). Such an elastic sheet is weaker than the torsion spring 203 in the force to push the vibration plate 201. Accordingly, in the case of powder that is greater in weight per unit volume, use of the torsion spring 203 is advantageous in that the contact member can sufficiently push the vibration plate 201. For example, two-component developer including toner and carrier is greater in weight per unit volume than one-component developer (toner). Accordingly, the vibration plate 201 can vibrate to the degree necessary for the developer amount detection using the magnetic flux sensor 204, and the developer amount can be detected accurately.

In the case where the contact member is an elastic sheet such as Mylar, the following inconvenience can arise if the rotation of the rotation shaft 96*c* is slow. After the contact member parts from the projection 202 of the vibration plate 201, the contact member fails to pass a vibration area of the vibration plate 201 (i.e., the area opposed to the vibration plate 201) promptly and disturbs the vibration of the vibration plate 201.

By contrast, in the case of the torsion spring 203, even if the rotation of the rotation shaft 96*c* is slow, the torsion spring 203 can revert to the stationary state promptly due to the force of the torsion coil spring after the contact portion 203*a* parts from the projection 202. Accordingly, the contact portion 203*a* of the torsion spring 203 can promptly pass the vibration area of the vibration plate 201 (i.e., the area opposed to the vibration plate 201). Thus, the torsion spring 203 does not disturb the vibration of the vibration plate 201, and the magnetic flux sensor 204 can detect the vibration of the vibration plate 201 accurately. Accordingly, the degradation in accuracy of developer amount detection is inhibited. It is to be noted that, as illustrated in FIG. 1 and the like, when the apex 202*b* is disposed in a downstream portion of the projection 202 in the rotation direction indicated by arrow Y1, the contact portion 203*a* can escape the projection 202 relatively quickly after flipping the projection 202.

Additionally, the second inclined face 202*c* of the projection 202 is advantageous in that, when the rotation shaft 96*c* rotates in reverse (counterclockwise in FIG. 1), the torsion spring 203, which rotates together with the rotation shaft 96*c*, moves on the second inclined face 202*c*. This confutation inhibits the contact portion 203*a* from being caught by the projection 202 and secures smooth reverse rotation of the torsion spring 203. Accordingly, damage to the torsion spring 203 or the rotation shaft 96*c* due to application of excessive load is inhibited.

Embodiment 2

Next, Embodiment 2 is described below. It is to be noted that the structure and operation of the image forming apparatus according to the present embodiment are basically similar to those of Embodiment 1, and the descriptions thereof are omitted.

Figure 24:
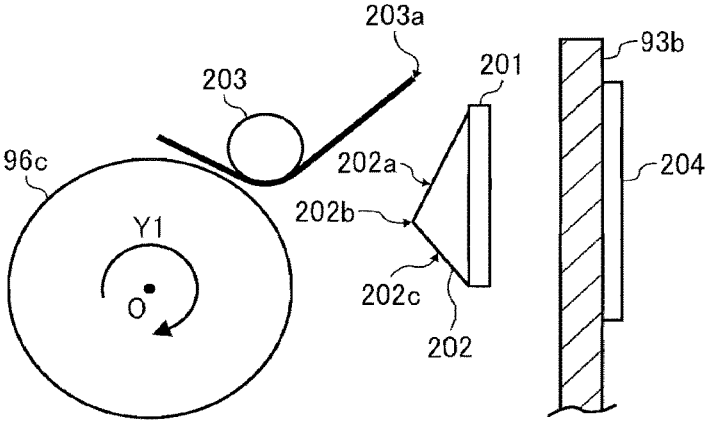
FIG. 24 is a schematic view of a structure to vibrate the vibration plate, according to Embodiment 2 and illustrates a state in which the torsion spring is about to contact the projection on the vibration plate.
Figure 25:
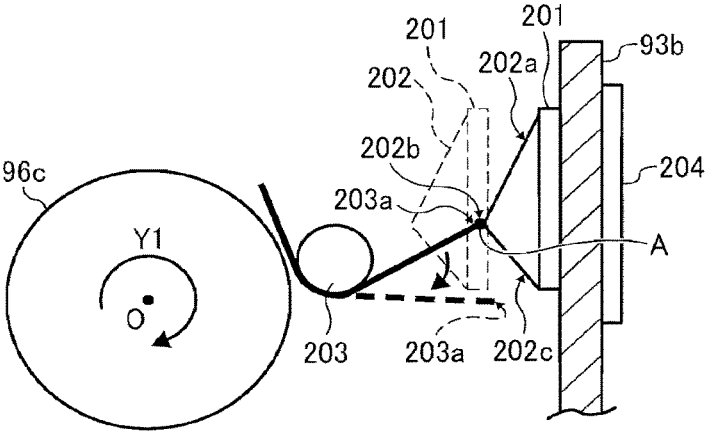
FIG. 25 illustrates a state in which the torsion spring, together with the rotation shaft, has rotated from the position illustrated in FIG. 24.

FIG. 24 illustrates a state in which the torsion spring 203 attached to the rotation shaft 96*c* of the first stirring conveyor 96 is about to contact the projection 202 of the vibration plate 201. The rotation shaft 96*c* rotates so that the torsion spring 203 rotates clockwise in FIG. 24. FIG. 25 illustrates a state in which the torsion spring 203, together with the rotation shaft 96*c*, is positioned downstream in the direction indicated by arrow Y1 from the position illustrated in FIG. 24. As illustrated in FIG. 25, the torsion spring 203 contacts the projection 202 and pushes the vibration plate 201 to the casing 93*b* of the sub-hopper 90. While the torsion spring 203 pushes the projection 202 as the rotation shaft 96*c* rotates, the torsion coil spring is twisted. As the rotation shaft 96*c* rotates further, the torsion spring 203 leaves the projection 202 and reverts to the shape indicated by broken lines in FIG. 25. Then, the vibration plate 201, which has been pushed to the casing 93*b*, vibrates to revert to the position indicated by broken lines in FIG. 25. Based on the vibration of the vibration plate 201 detected by the magnetic flux sensor 204, the CPU 21 detects the amount of developer.

Figure 26:
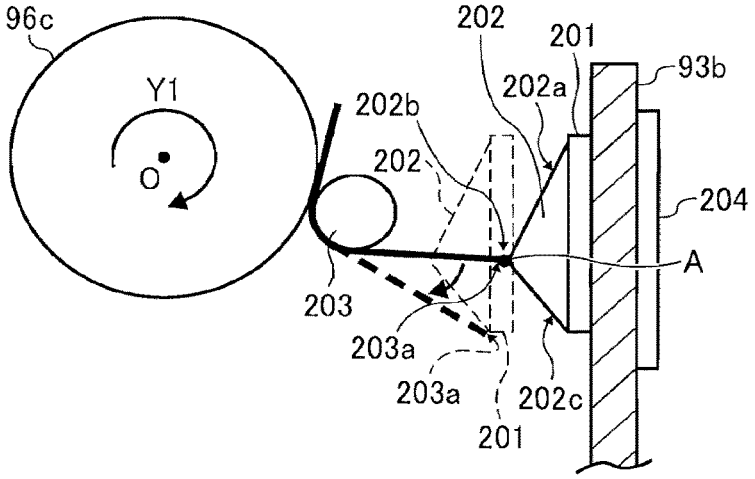
FIG. 26 illustrates a state in which the torsion spring pushes the vibration plate in an arrangement in which a rotation center of the torsion spring is above a contact position between the torsion spring and the projection.

FIG. 26 illustrates a state in which the torsion spring 203 pushes the vibration plate 201 to the casing 93*b* in an arrangement in which a rotation axis O (rotation center) of the torsion spring 203 is above a contact position A between the torsion spring 203 and the projection 202. In the arrangement in which the rotation axis O of the torsion spring 203 is above the contact position A between the torsion spring 203 and the projection 202, the following inconvenience can arise. When the contact portion 203*a* leaves the projection 202 and returns to the position indicated by broken lines in FIG. 26, the contact portion 203*a* may fail to exit the vibration area of the vibration plate 201 (i.e., the area opposed to the vibration plate 201). Then, the contact portion 203*a* again contacts the vibration plate 201 and disturbs the vibration of the vibration plate 201, thus degrading the accuracy of developer amount detection.

By contrast, in the arrangement in which the rotation axis O is below the contact position A as illustrated in FIG. 25, when the contact portion 203*a* leaves the projection 202 and returns to the position indicated by broken lines in FIG. 25, the contact portion 203*a* promptly exits the vibration area of the vibration plate 201 (i.e., the area opposed to the vibration plate 201). Thus, the torsion spring 203 does not disturb the vibration of the vibration plate 201, and the magnetic flux sensor 204 can detect the vibration of the vibration plate 201 accurately. Accordingly, the amount of developer can be detected accurately.

In the configuration in which the contact portion 203*a* slides on the first inclined face 202*a* of the projection 202, the rotation axis O of the rotation shaft 96*c* is below the range of the projection 202 in which the contact portion 203*a* contacts (i.e., the first inclined face 202*a* and the apex 202*b*).

Figure 27:
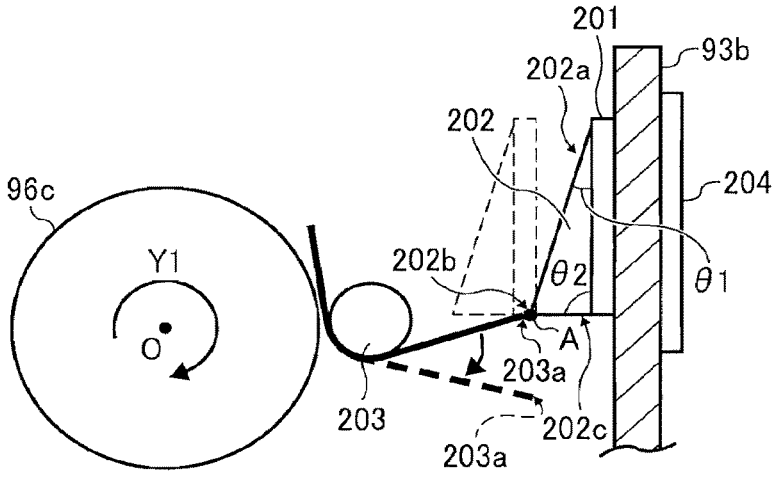
FIG. 27 illustrates a shape of the projection in which an inclination of a downstream inclined face is greater than an inclination of an upstream inclined face.

FIG. 27 illustrates a shape of the projection 202 in which an angle θ2 of the second inclined face 202*c* relative to the face of the vibration plate 201 is greater than an angle θ1 of the first inclined face 202*a* relative to the face of the vibration plate 201. The angle θ2 is downstream from the angle θ1 in the rotation direction indicated by arrow Y1. In the shape in which the inclination (i.e., the angle θ2) of the second inclined face 202*c* is greater than the inclination (i.e., the angle θ1) of the first inclined face 202*a*, the contact position A between the contact portion 203*a* and the projection 202 is positioned in the downstream side in the projection 202 in the rotation direction of the torsion spring 203. This configuration makes it easier for the contact portion 203*a* to exit the vibration area of the vibration plate 201 (i.e., the area opposed to the vibration plate 201) when the contact portion 203*a* leaves the projection 202 and returns to the position indicated by broken lines. Thus, the torsion spring 203 does not disturb the vibration of the vibration plate 201, and the amount of developer can be detected accurately.

Embodiment 3

Next, Embodiment 3 is described below. It is to be noted that the structure and operation of the image forming apparatus according to the present embodiment are basically similar to those of Embodiment 1, and the descriptions thereof are omitted.

Figure 28:
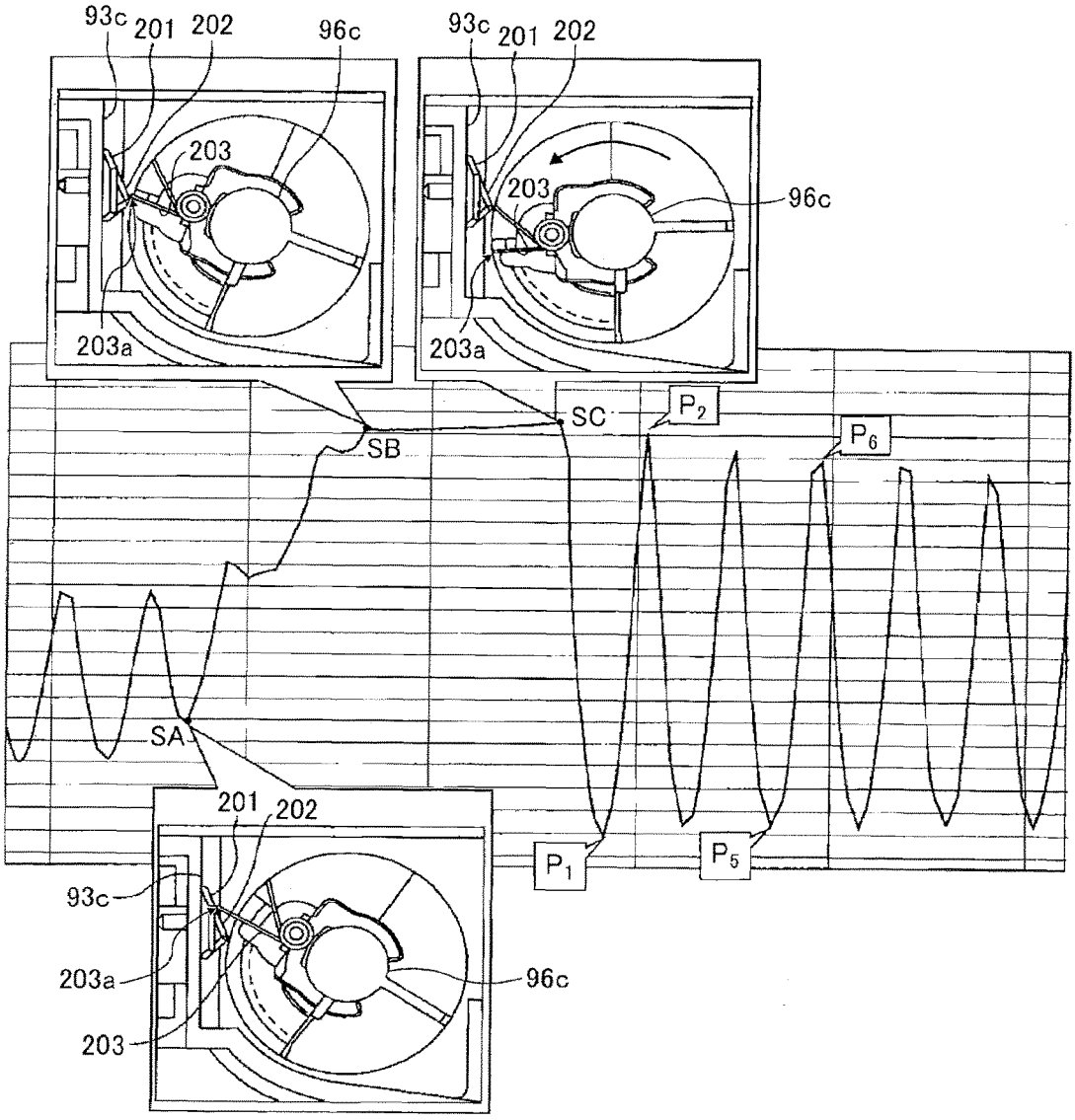
FIG. 28 is a chart illustrating a relation between the contact state of the torsion spring with the projection and changes in the count value of the oscillation signal from the magnetic flux sensor, according to Embodiment 3.

FIG. 28 is a chart illustrating a relation between the contact state of the contact portion 203*a* of the torsion spring 203 (with the projection 202 of the vibration plate 201) and changes in the count value of the oscillation signal from the magnetic flux sensor 204. In FIG. 28, at Point SA, the contact portion 203*a* of the torsion spring 203 starts contacting the projection 202 of the vibration plate 201. At Point SB in FIG. 28, pushed by the torsion spring 203, the vibration plate 201 contacts a face 93*c* of the casing 93*b*. At Point SC in FIG. 28, the contact portion 203*a* of the torsion spring 203 is in the state immediately before exiting the range in which the contact portion 203*a* contacts the projection 202. In the graph of FIG. 28, the ordinate represents the count values of the oscillation signal output from the magnetic flux sensor 204, and the graph includes Peaks $P_1$, $P_2$, $P_5$, and $P_6$, of fluctuations in the count values.

The vibration of the vibration plate 201 attenuates differently depending on the resistance difference due to the presence or absence of developer around the vibration plate 201. Based on this principle, the amount of developer is detected using the magnetic flux sensor 204 in the present embodiment. Accordingly, the vibration plate 201 is a thin plate made of a material having a relatively low spring constant, such as stainless steel, for example. To flip the vibration plate 201, the torsion spring 203 contacts the vibration plate 201 to push the vibration plate 201; and promptly exits, with the elastic force of the torsion coil spring, the vibration range of the vibration plate 201 while passing the range of contact with the vibration plate 201. Additionally, after flipping the vibration plate 201, the torsion spring 203 does not again contact the vibration plate 201 to hinder the vibration. To attain these actions, the torsion spring 203 (i.e., the contact member) is configured such that, i) the torsion spring 203 is squeezed with elasticity while contacting the vibration plate 201 until leaving the vibration plate 201, and ii) the torsion spring 203 moves quickly due to the release of elastic force when leaving the vibration plate 201.

Figure 29:
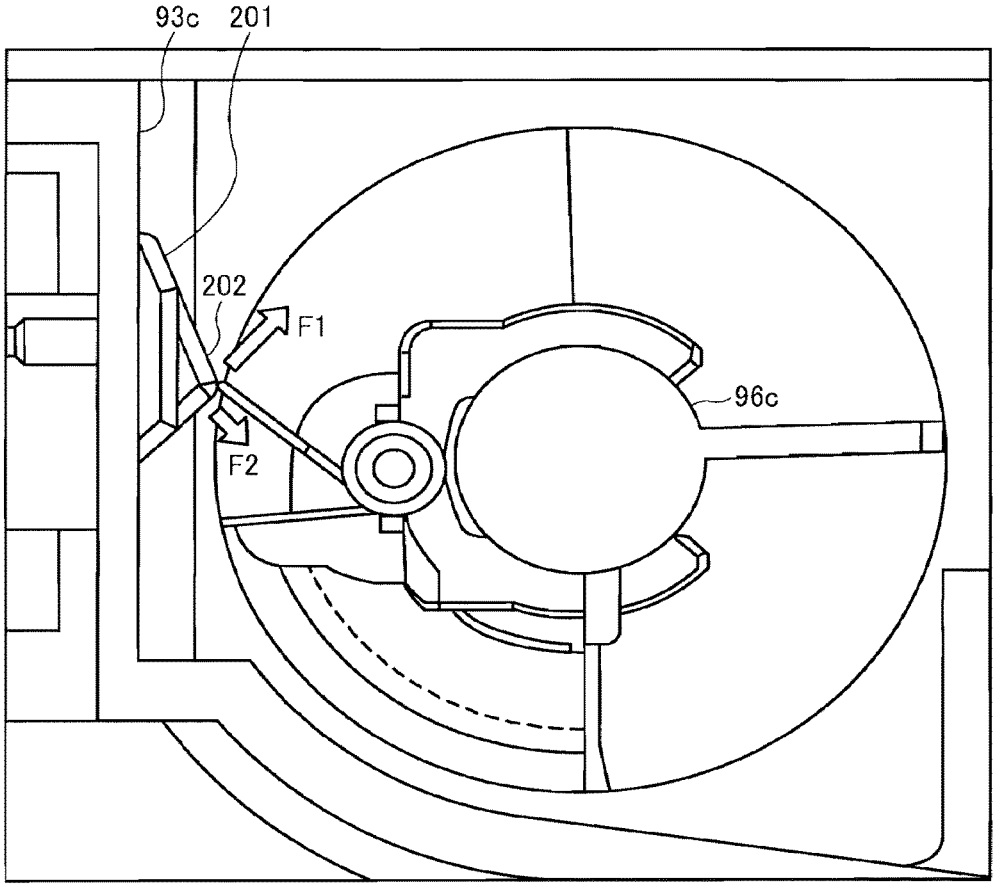
FIG. 29 illustrates force applied to the torsion spring when the torsion spring pushes the vibration plate.

FIG. 29 illustrates the force applied to the torsion spring 203 when the torsion spring 203 pushes the vibration plate 201. In FIG. 29, arrow F1 represents the force in the direction in which the torsion coil can absorb the force, and F2 represents the force in the direction in which the torsion coil does not absorb the force. When the force is not absorbed, the spring slackens. Regarding the elastic force of the torsion spring 203, a spring load sufficient to push the vibration plate 201 is necessary. However, setting the load to a relative large load is disadvantageous in that, the torsion spring 203 wears while sliding on the vibration plate 201. The large load setting is also disadvantageous in absorbing an impact load, which occurs each time the torsion spring 203 contacts the vibration plate 201. While the torsion spring 203 passes the range of contact with the vibration plate 201, the stress in a direction other than the twisting direction of the torsion spring 203 occurs, and the stress increases when the load setting is large. Accordingly, the margin for fatigue fracture will be insufficient.

Figure 30:
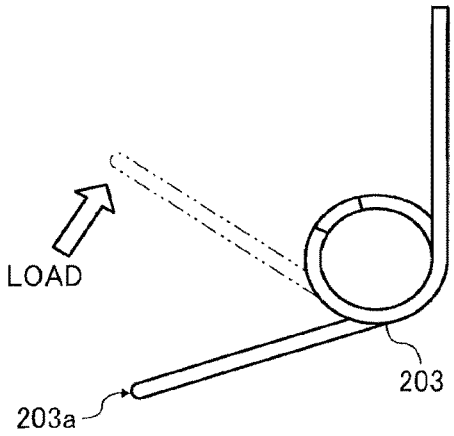
FIG. 30 is a schematic view of the torsion spring in a state under application of load and a state free from the load.
Figure 31:
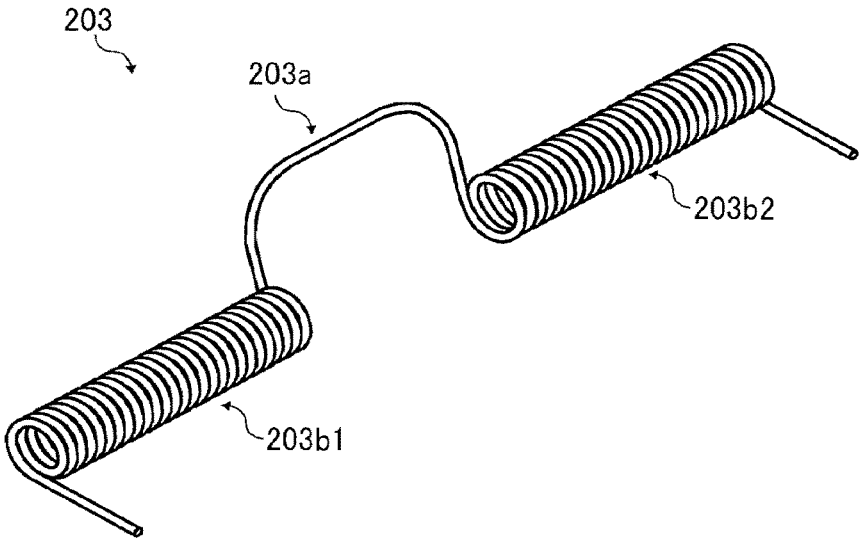
FIG. 31 is a perspective view of a double torsion spring according to an embodiment.
Figure 32:
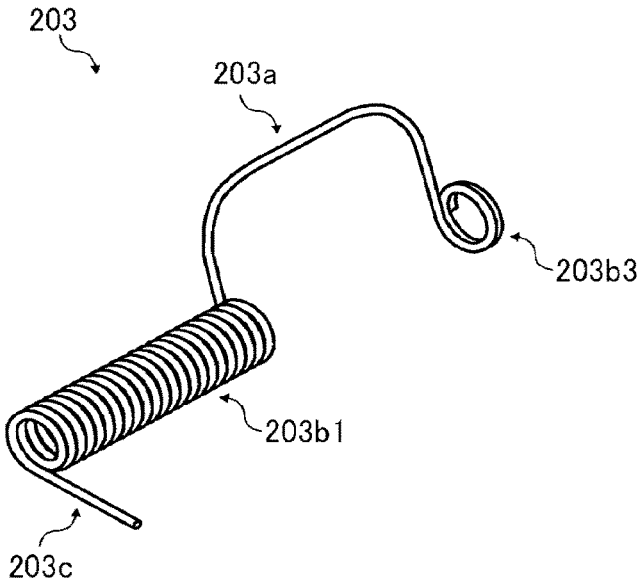
FIG. 32 is a perspective view of a single torsion spring according to an embodiment.

FIG. 30 is a schematic view of a state of the torsion spring 203 under the load and a state free from the load. In FIG. 30, solid lines represent the torsion spring 203 free from the load. As a load of 0.12 N, for example, is applied to the contact portion 203*a* of the torsion spring 203 represented by the solid lines, the contact portion 203*a* moves to the position indicated by alternate long and short dashed lines. If the wire diameter of the torsion spring 203 is increased to reduce the spring load, the size differs between a double torsion spring and a single torsion spring even if the spring load is identical. Additionally, choice of a highly durable material or a thicker wire differs in designing the spring. For example, the torsion spring 203 illustrated in FIG. 31 is a double torsion spring made of stainless steel spring wire (SUS 304-WPB) having a wire diameter of 0.32 mm. The number of turns of each of coiled portions 203*b*1 and 203*b*2 (also collectively "coiled portions 203*b*") is 28.2. In the structure illustrated in FIG. 31, the margin of fatigue fracture of the torsion spring 203 is greater, compared with a torsion spring made of piano wire type B (SWP-B). The torsion spring 203 illustrated in FIG. 32 is a single torsion spring made of piano wire type B (SWP-B) having a wire diameter of 0.35 mm. The number of turns of the coiled portion 203*b*1 illustrated in FIG. 32 is 22.2. Compared with the spring wire having a wire diameter of 0.32 mm, the torsion spring 203 illustrated in FIG. 32 is advantageous in that the spring load can be reduced. Simultaneously, the critical tensile stress is 1.37 times of that of the torsion spring having a wire diameter of 0.32 mm, and the margin of fatigue fracture of the torsion spring 203 increases.

As illustrated in FIG. 31, in the structure in which both ends of the contact portion 203*a* of the double torsion spring are supported by the coiled portions 203*b*1 and 203*b*2, respectively, the position of contact of the contact portion 203*a* with the vibration plate 201 can be stabilized. However, if the torsion spring 203 is designed to have the shape illustrated in FIG. 31, a thicker diameter to secure the spring strength, and a smaller elastic force, the coiled portions 203*b*1 and 203*b*2 on both sides of the contact portion 203*a* are significantly long. Such a long spring makes it difficult to dispose the torsion spring 203 in the sub-hopper 90 and increases the cost of the torsion spring 203.

By contrast, as illustrated in FIG. 32, the torsion spring 203 includes a coiled portion 203*b*3 instead of the coiled portion 203*b*2. In FIG. 32, while the coiled portions 203*b*1 and 203*b*3 (also collectively "coiled portions 203*b*") support the contact portion 203*a* from both sides, the coiled portion 203*b*1 includes a rotation stopper 203*c* (i.e., a supported point). The rotation stopper 203*c* is supported by a spring end support 96*f* disposed on the rotation shaft 96*c*. The coiled portion 203*b*3 is not provided with a rotation stopper. The coiled portion 203*b*3 has a continuous circular shape in which the number of turns is smaller than the number of turns of the coiled portion 203*b*1 so that the coiled portion 203*b*3 does not contribute to the spring elasticity. This configuration can keep the length of the coiled portion 203*b*3 short. Accordingly, this configuration makes it easier to dispose the torsion spring 203 in the sub-hopper 90 and suppresses the cost of the torsion spring 203.

Thus, the contact position of the torsion spring 203 on the vibration plate 201 can be stabilized. Simultaneously, the torsion spring 203 has a relatively thick wire diameter to enhance tensile stress of the material, which is an index of strength relative to fatigue fracture, and the elastic force of the torsion coil is kept at or close to a minimum necessary for the function of the torsion spring 203. With this configuration, the contact impact between the torsion spring 203 and the vibration plate 201 can be absorbed, and wear of the contact portion of the vibration plate 201 that contacts the torsion spring 203 can be suppressed.

It is to be noted that the powder, the amount of which is detected, is not limited to developer but can be, for example, flour, metal powder, or resin particulates. The above-described effects are available also in devices to handle such powders.

Embodiment 4

Next, Embodiment 4 is described below with reference to FIGS. 33A and 33B. It is to be noted that the structure and operation of the image forming apparatus according to the present embodiment are basically similar to those of Embodiment 1, and the descriptions thereof are omitted.

Figure 33A:
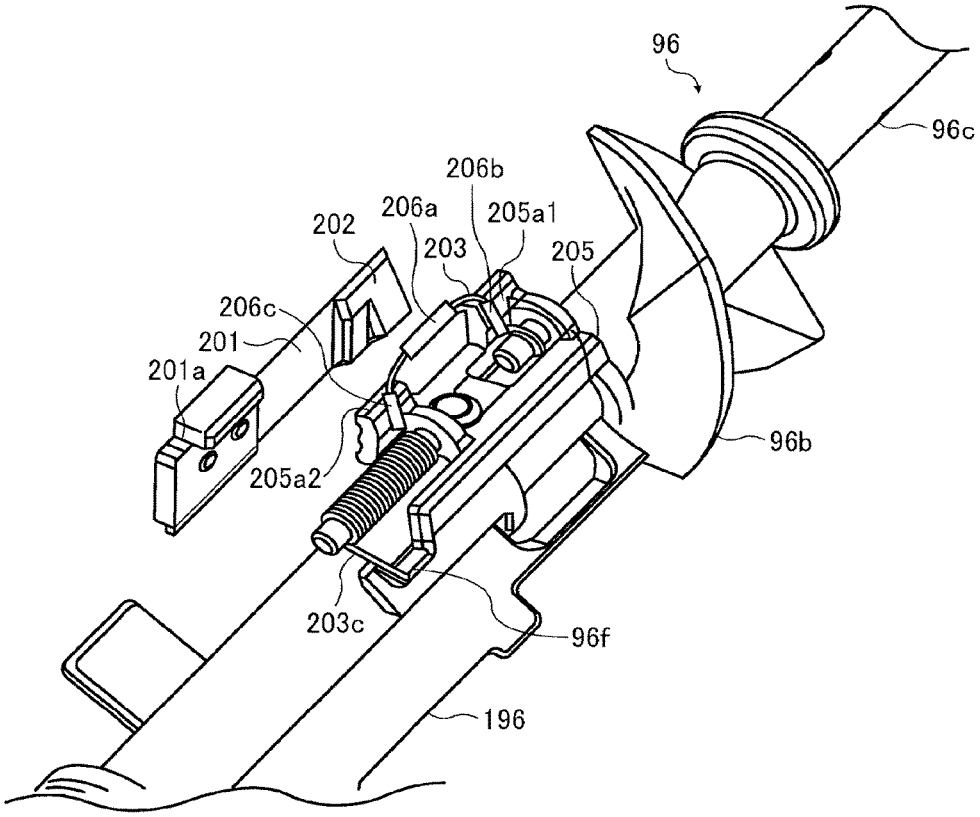
FIG. 33A is a perspective view of a structure to vibrate the vibration plate, according to Embodiment 4.
Figure 33B:
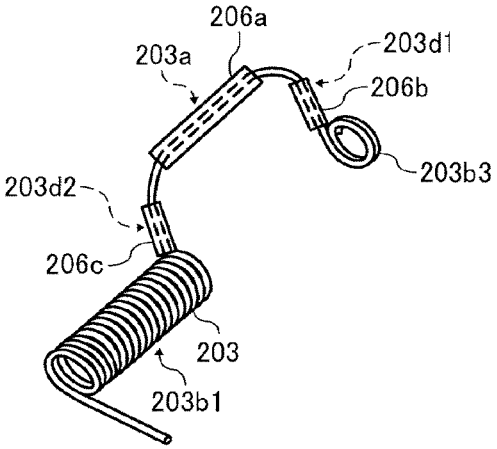
FIG. 33B is a perspective view of the torsion spring illustrated in FIG. 33A, to which pads are attached.

As described above with reference to FIG. 1 and the like, the rotation shaft 96*c* rotates so that the torsion spring 203 rotates clockwise in FIG. 33A. The contact portion 203*a* is connected via arms 203*d*1 and 203*d*2 to the coiled portions 203*b*1 and 203*b*2, respectively. As the rotation shaft 96*c* of the first stirring conveyor 96 rotates, the contact portion 203*a* of the torsion spring 203 contacts the projection 202 and pushes the vibration plate 201 to the casing 93*b* of the sub-hopper 90. The torsion spring 203 receives an impact load as the contact portion 203*a* contacts the projection 202. Additionally, while the contact portion 203*a* leaves the projection 202 and the torsion spring 203 reverts to the stationary state, the arms 203*d*1 and 203*d*2 of the torsion spring 203 contact walls 205*a*1 and 205*a*2 of the holder 205, which is another impact load for the torsion spring 203. Consequently, each time the torsion spring 203 vibrates the vibration plate 201, an identical portion of the torsion spring 203 repeatedly receives the impact load, and there is a risk of damage to the torsion spring 203.

FIG. 33A is a perspective view of a structure to vibrate the vibration plate 201 according to Embodiment 4, in which pads 206*a*, 206*b*, and 206*c* (i.e., cushion for impact absorption) are attached to the torsion spring 203. FIG. 33B is a perspective view of the torsion spring 203 to which the pads 206*a*, 206*b*, and 206*c* are attached. In the present embodiment, the pads 206*a*, 206*b*, and 206*c*, which are tubular elastic bodies, are respectively attached to the contact portion 203*a* and the arms 203*d*1 and 203*d*2 (also collectively "arms 203*d*"). The pad 206*a* reduces the contact impact applied to the contact portion 203*a* when the contact portion 203*a* contacts the projection 202 via the pad 206*a*. When the arms 203*d*1 and 203*d*2 contact, via the pads 206*b* and 206*c*, the walls 205*a*1 and 205*a*2 of the holder 205, the contact load applied to the arms 203*d*1 and 203*d*2 are reduced. Thus, the load on the torsion spring 203 is reduced. Accordingly, the durability of the torsion spring 203 is improved.

The inner diameter of the pad 206*a* can be made greater than the wire diameter of the contact portion 203*a* to make the pad 206*a* rotatable relative to the torsion spring 203. For example, the amount of twist of the torsion spring 203 is greater when the friction between the projection 202 and the pad 206*a*, which is attached to the contact portion 203*a* of the torsion spring 203, is greater. As a result, momentum of the torsion spring 203 reverting to the stationary state increases, and the torsion spring 203 receives a greater impact from the holder 205. By contrast, when the pad 206*a* is rotatable around the torsion spring 203, the pad 206*a* rolls on the surface of the projection 202. Accordingly, increases in the twist of the torsion spring 203 are suppressed. Thus, the impact between the torsion spring 203 and the holder 205 is reduced, thereby improving the durability of the torsion spring 203. It is to be noted that, for example, elastic resin and rubber are usable for the pads 206*a*, 206*b*, and 206*c*.

Embodiment 5

Next, Embodiment 5 is described below. It is to be noted that the structure and operation of the image forming apparatus according to the present embodiment are basically similar to those of Embodiment 1, and the descriptions thereof are omitted.

Figure 34:
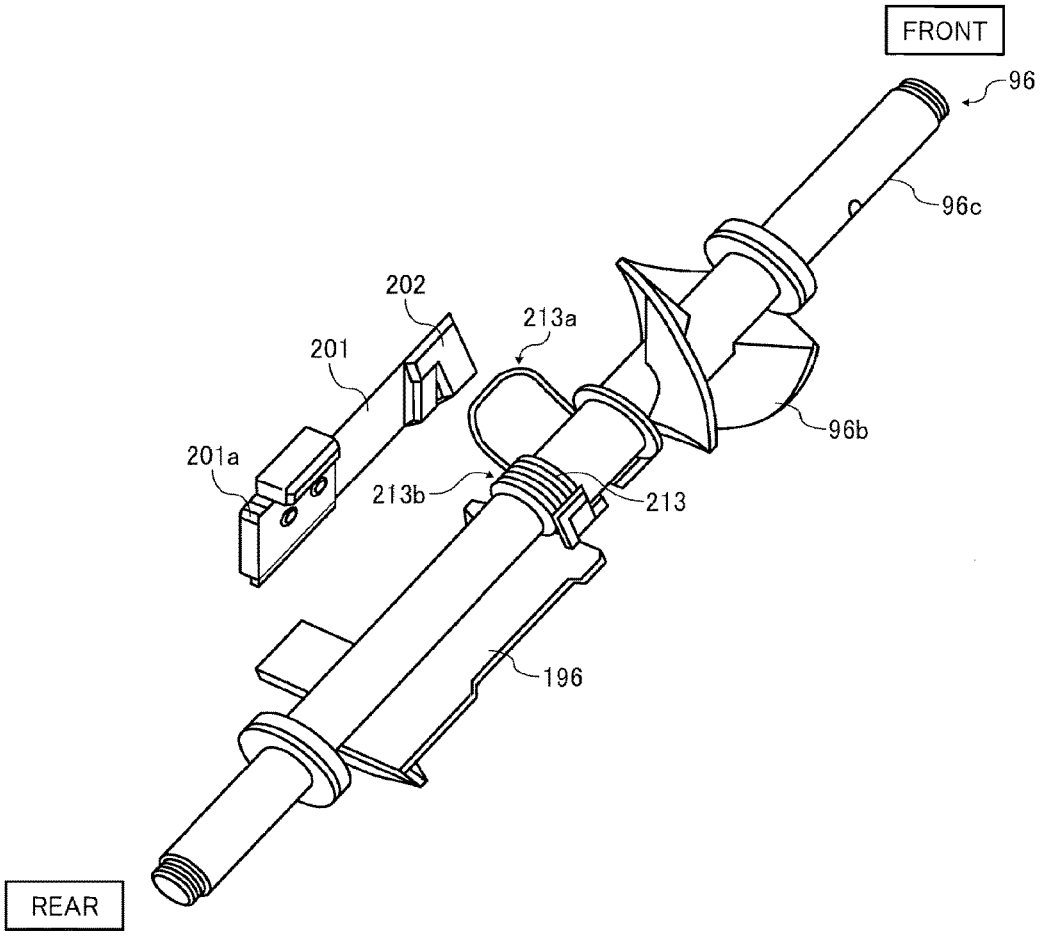
FIG. 34 is a perspective view of a first stirring conveyor according to Embodiment 5, to which a torsion spring is attached without a holder.

FIG. 34 is a perspective view of a torsion spring 213 attached to the rotation shaft 96*c* of the first stirring conveyor 96. In the present embodiment, the holder 205 illustrated in FIG. 22A is not attached to the first stirring conveyor 96. A coiled portion 213*b* is fitted around the rotation shaft 96*c*, and the torsion spring 213 is directly attached to the rotation shaft 96*c*.

Figure 35:
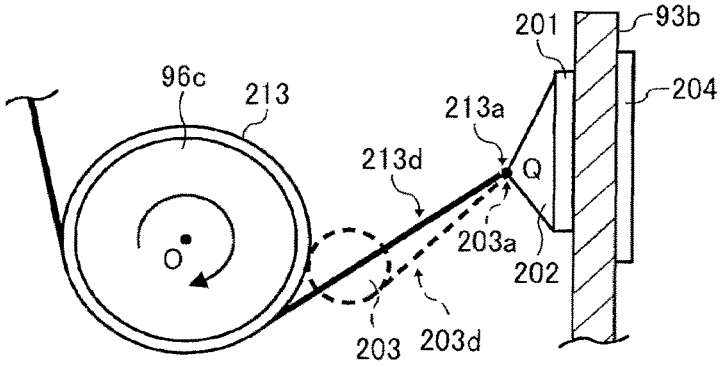
FIG. 35 is a side view illustrating a state in which the torsion spring illustrated in FIG. 34 pushes the projection of the vibration plate.
Figure 36:
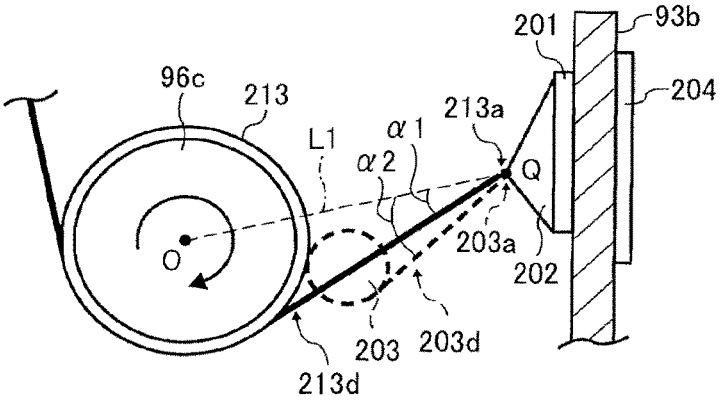
FIG. 36 is a side view illustrating an angle between an arm of the torsion spring and a virtual line connecting a rotation center of the torsion spring and a contact point between the torsion spring and the projection in the structure illustrated in FIG. 35.
Figure 37:
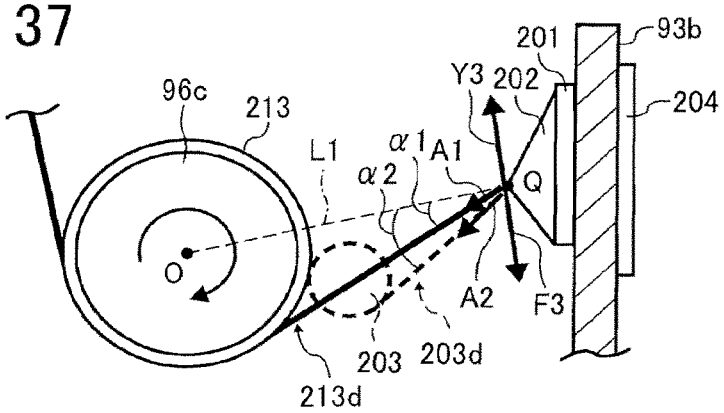
FIG. 37 illustrates force applied to the torsion spring when the torsion spring contacts the projection of the vibration plate in the structure illustrated in FIG. 35.

FIGS. 35, 36, and 37 are side views illustrating a state in which the torsion spring 213 illustrated in FIG. 34 pushes the projection 202 of the vibration plate 201. Broken lines represent the torsion spring 203, which is attached via the holder 205 to the rotation shaft 96*c* of the first stirring conveyor 96.

In FIG. 36, reference character Q represents a contact point between a contact portion 213*a* of the torsion spring 213 (or the contact portion 203*a* of the torsion spring 203) and the projection 202, and L1 represents a virtual line connecting the rotation axis O of the torsion spring 213 (or 203) and the contact point Q. An arm 213*d* of the torsion spring 213 and the virtual line L1 together form an angle $\alpha 1$, and the arm 203*d* of the torsion spring 203 and the virtual line L1 together form an angle $\alpha 2$. In this case, the angle $\alpha 1$ between the arm 213*d* of the torsion spring 213 and the virtual line L1 is smaller than the angle $\alpha 2$ between the arm 203*d* of the torsion spring 203 and the virtual line L1 ($\alpha 1 < \alpha 2$).

The contact point Q is preferably a point at which the torsion spring 213 contacts the vibration plate 201 immediately before leaving the vibration plate 201. In the configuration in which the contact portion 213*a* slides on the inclined face of the projection 202, the contact point Q is at an end (i.e., a contact end point, which is an apex of the projection 202 in FIG. 36) of the range of the projection 202 in which the contact portion 213*a* contacts.

The torsion spring 213 receives force indicated by arrow Y3 illustrated in FIG. 37 when the torsion spring 213 contacts the projection 202 of the vibration plate 201. Arrow F3 represents the force due to the rotation of the rotation shaft 96*c*. Additionally, the stress in the direction other than the twisting direction of the coiled portion 213*b* (or 203*b*) is geometrically represented by arrow A1 in the case of the torsion spring 213 and by arrow A2 in the case of the torsion spring 203 (A1<A2). Accordingly, when the torsion spring 213 is attached directly to the rotation shaft 96*c*, the stress in the direction other than the twisting direction of the coiled portion 213*b* can be smaller, compared with the configuration in which the torsion spring 203 is attached to the holder 205. Accordingly, the durability of the torsion spring 203 is improved.

Increasing the inner diameter of the coiled portion 213*b* is advantageous in that the wire diameter can be increased without increasing the spring load of the torsion spring 213. Accordingly, the strength of the torsion spring 213 can be increased without increasing the force applied to the torsion spring 213 when the torsion spring 213 contacts the projection 202 of the vibration plate 201. In the present embodiment, when the spring load of the torsion spring is identical, the stress on the torsion spring 213 (having a wire diameter of 0.45 mm) in the direction other than the twisting direction of the coiled portion 213*b* is about one third, compared with the torsion spring 203 (having a wire diameter of 0.35 mm) attached to the holder 205.

Embodiment 6

Next, Embodiment 6 is described below. It is to be noted that the structure and operation of the image forming apparatus according to the present embodiment are basically similar to those of Embodiment 1, and the descriptions thereof are omitted.

Figure 38:
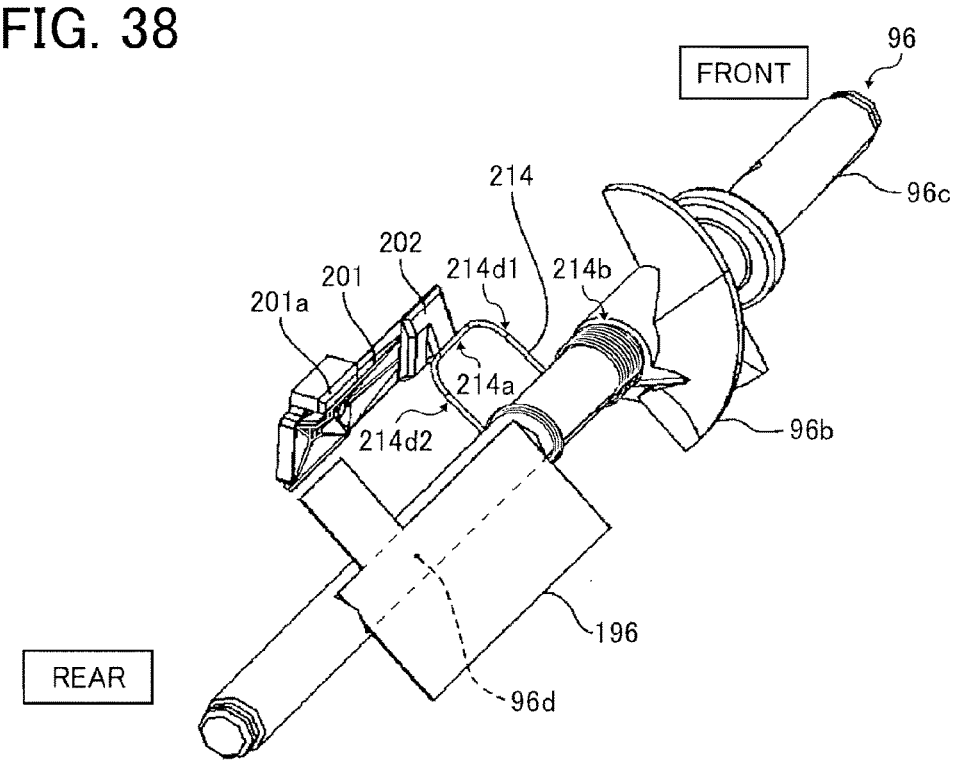
FIG. 38 is a perspective view of a structure to vibrate the vibration plate, according to Embodiment 6.
Figure 39:
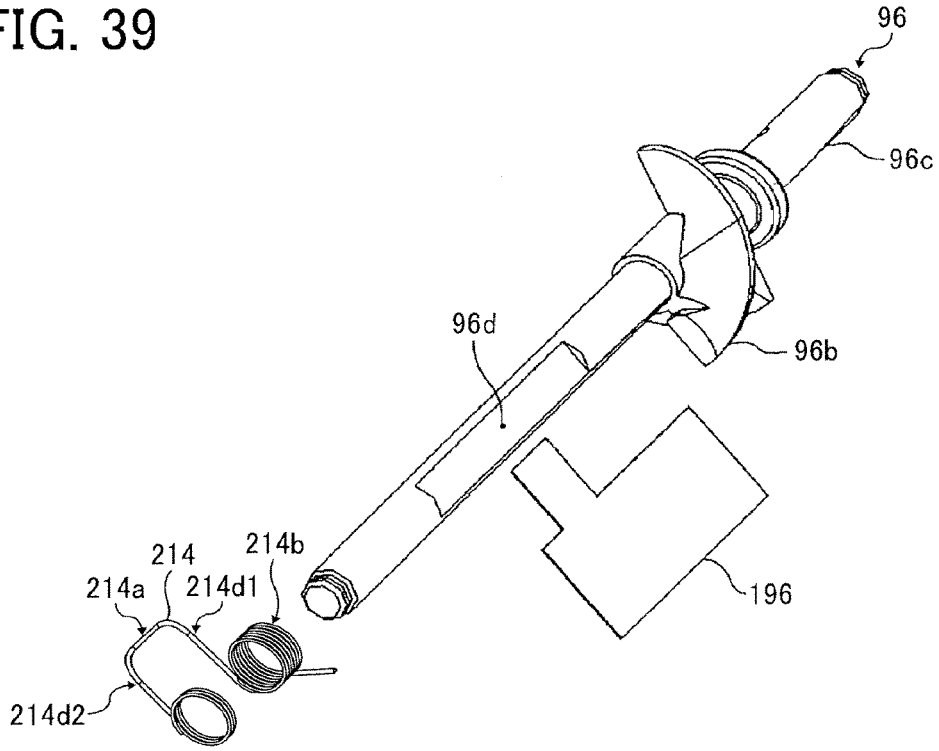
FIG. 39 is an exploded view of the structure illustrated in FIG. 38.

FIG. 38 is a perspective view of a structure using a torsion spring 214 to vibrate the vibration plate 201 according to the present embodiment. FIG. 39 is an exploded view of the structure to vibrate the vibration plate 201.

The vibration plate 201 is secured via the mount 201*a* to the casing 93*b* of the sub-hopper 90. A coiled portion 214*b* of the torsion spring 214 is fitted around the rotation shaft 96*c* of the first stirring conveyor 96, and the torsion spring 214 is set close to the screw blade 96*b*. The rotation shaft 96*c* of the first stirring conveyor 96 has a bonding area 96*d* to which an agitator 196 to stir the developer is attached. In the axial direction of the rotation shaft 96*c*, the bonding area 96*d* is disposed opposite the screw blade 96*b* across the torsion spring 214 as illustrated in FIG. 38. With this structure, the torsion spring 214, the agitator 196, and the first stirring conveyor 96 are united together and rotate together around the rotation shaft 96*c*. As the first stirring conveyor 96 rotates, a contact portion 214*a* of the torsion spring 214 pushes the projection 202 on the vibration plate 201. Then, the vibration plate 201 deforms to bend. As the first stirring conveyor 96 rotates further, the torsion spring 214 parts from the projection 202. Then, the vibration plate 201 vibrates to return to the predetermined position in the stationary state.

A preferable material for the torsion spring 214 is elastic wire made of, for example, hard drawn steel wire type C (SW-C), piano wire type A (SWP-A), piano wire type B (SWP-B), or stainless steel spring wire (SUS 304-WPB) according to Japanese Industrial Standards (JIS). However, the material for the torsion spring 203 is not limited thereto. Although the torsion spring 214 in the present embodiment is a single torsion spring, in which a torsion coiled spring is disposed on one side, the shape of the torsion spring 203 is not limited thereto. For example, a double torsion spring can be used instead. The force to push the vibration plate 201 is adjustable with the material of the torsion spring 214 or the number of turns of the coiled portion 214*b*. The force to push the vibration plate 201 is changed when, for example, the developer having a greater weight is used.

In the present embodiment, the rotation shaft 96*c* is inserted into the coiled portion 214*b* to match a center $O_2$ of the coiled portion 214*b* in the radial direction to the rotation axis O of the rotation shaft 96*c*. The center $O_2$ is a center of support of the torsion spring 214. This configuration can alleviate layout limitations imposed on the diameter of the coiled portion 214*b*. Accordingly, the diameter of the coiled portion 214*b* can be greater compared with a configuration in which the center $O_2$ of the coiled portion 214*b* does not match the rotation axis O of the rotation shaft 96*c*. In this case, while a thick wire can be selected for the torsion spring 214 to increase the spring strength, the spring elastic force and the coil length can be set to relatively small values from the reason below. Since the wire length is secured in the coiled portion 214*b*, a local stress due to the bending moment in the coiled portion 214*b* during twisting is reduced.

Additionally, the distance from the center $O_2$ of the coiled portion 214*b* to the contact point Q (point of action) between the contact portion 214*a* and the projection 202 can be greater. Additionally, a torsion angle can be smaller relative to the distance by which arms 214*d*1 and 214*d*2 (collectively "arms 214*d*") are bent to flip the vibration plate 201. With this configuration, a larger wire diameter is selectable relative to the stress (the force to push the vibration plate 201) of the arms 214*d*1 and 214*d*2 necessary to flip the vibration plate 201.

Figure 40:
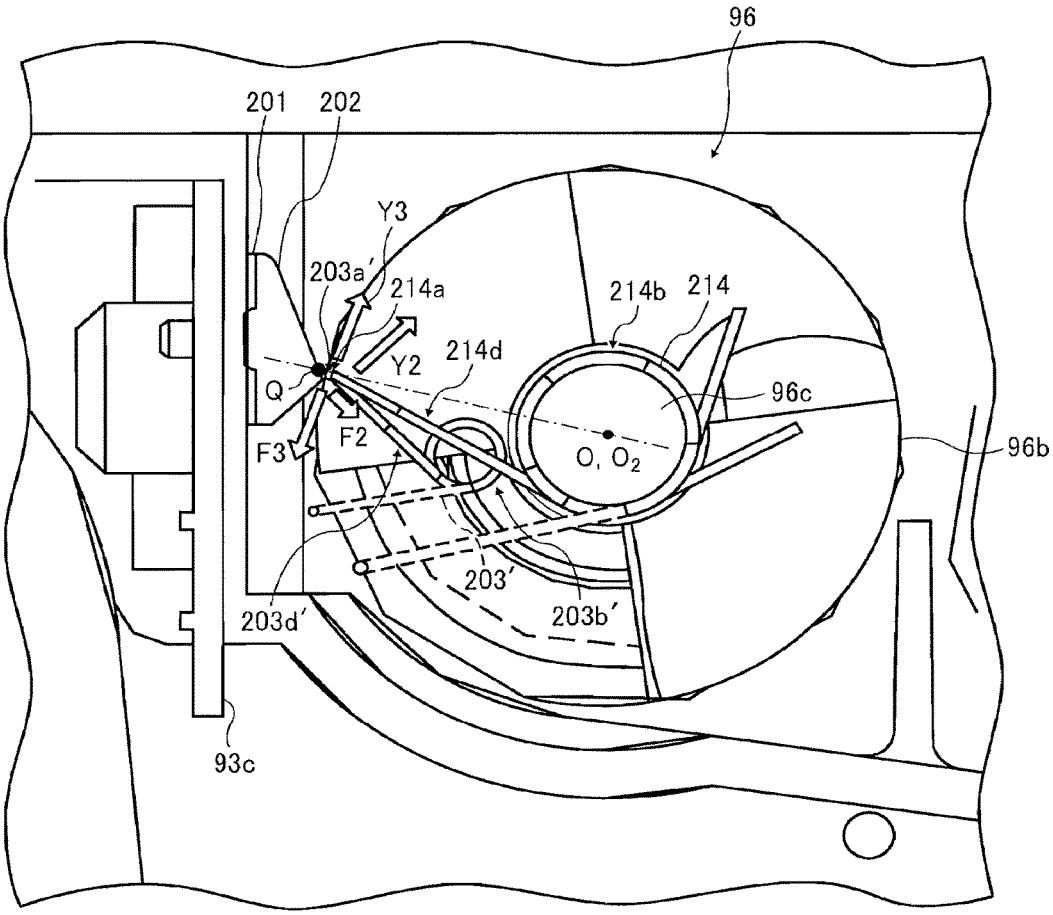
FIG. 40 illustrates a layout of the torsion spring according to Embodiment 6 and a torsion spring according to a comparative example.

Further, the center of torsion of the torsion spring 214 matches the center of movement of the torsion spring 214 due to the rotation of the first stirring conveyor 96. Accordingly, referring to FIG. 40, even at a moment immediately before the torsion spring 214 flips the vibration plate 201, the direction indicated by arrow Y3, in which the torsion spring 214 is twisted to escape, approximately matches the direction of reactive force applied to the torsion spring 214 in the tangential direction as the rotation shaft 96*c* rotates. In FIG. 40, arrow F3 represents the force due to the rotation of the rotation shaft 96*c*. Then, the coiled portion 214*b* can absorb the reactive force, reducing the bending of the spring due to the force in the direction not to be absorbed. Therefore, the margin for the fatigue fracture over time can increase. It is to be noted that, at the moment immediately before the torsion spring 214 flips the vibration plate 201, the contact portion 214*a* is in contact with the projection 202 and inhibited from moving, and the load on the torsion spring 214 is greatest.

FIG. 40 illustrates the layout of the torsion spring 214 according to Embodiment 6 and a torsion spring 203' according to a comparative example. The torsion spring 203' includes a contract portion 203*a*', a coiled portion 203*b*' and an arm 203*d*'. In the comparative example, the center of the coiled portion 203*b*' in the radial direction does not match the rotation center of the shaft 96*c*. In the comparative example, use of a thicker wire is for the torsion spring 203' is inhibited due to layout limitations on the diameter of the coiled portion 203*b*'. By contrast, in Embodiment 6, since the layout limitations on the diameter of the coiled portion 214*b* are smaller, a thicker wire is selectable for the torsion spring 214. In the present embodiment, the moving direction (arrow F3) and twisting direction (arrow Y3) of the torsion spring 214 are tangential to the rotation shaft 96*c*. By contrast, in the comparative example, the twisting direction, indicated by arrow Y2 in FIG. 40, deviates from the direction tangential to the rotation shaft 96*c*. Accordingly, in the comparative example indicated by broken lines in FIG. 40, while the torsion spring 203' is twisted to escape in the direction indicated by arrow Y2, the force (indicated by arrow F2) in the direction to bend the contact portion 203*a*' of the torsion spring 203' occurs.

Embodiment 7

Next, Embodiment 7 is described below. It is to be noted that the structure and operation of the image forming apparatus according to the present embodiment are basically similar to those of Embodiment 1, and the descriptions thereof are omitted.

Figure 41:
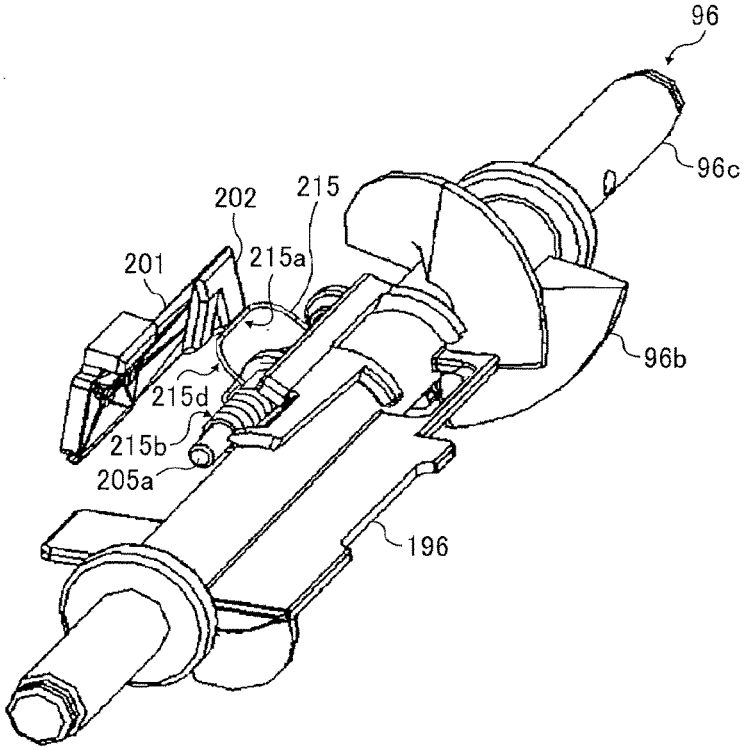
FIG. 41 is a perspective view of a structure including a torsion spring according to Embodiment 7, in a state immediately before the torsion spring flips the vibration plate.
Figure 42:
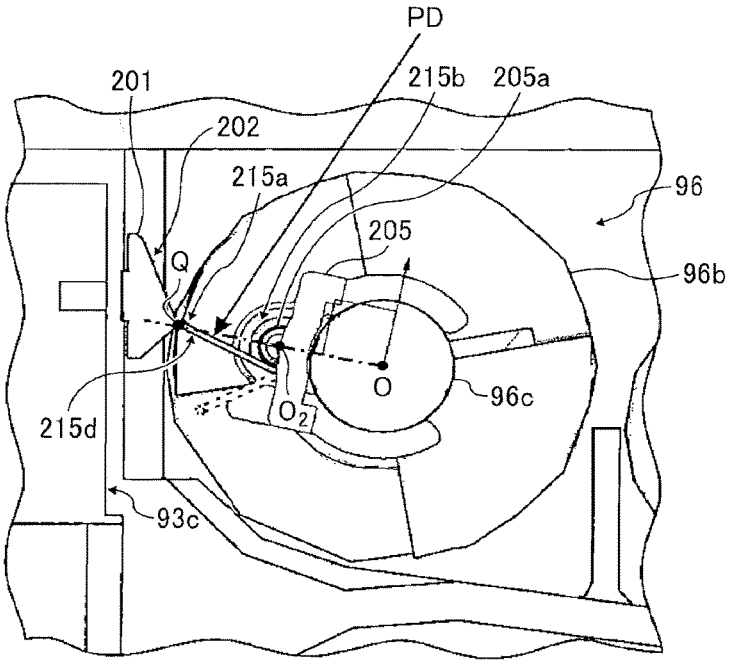
FIG. 42 illustrates relative positions of the rotation axis of the rotation shaft, a radial center of a coiled portion, and the contact point, at a moment immediately before the torsion spring leaves the projection in the structure illustrated in FIG. 41.

FIG. 41 is a perspective view of a structure including a torsion spring 215, in a state immediately before the torsion spring 215 flips the vibration plate 201. FIG. 42 illustrates relative positions of the rotation axis O (rotation center) of the rotation shaft 96*c*, a center $O_3$ in the radial direction of a coiled portion 215*b*, and the contact point Q between the contact portion 215*a* and the projection 202, at a moment immediately before a contact portion 215*a* leaves the projection 202. In the present embodiment, as illustrated in FIGS. 41 and 42, the torsion spring 215 is attached to the holder 205 disposed on the rotation shaft 96*c*. The holder 205 includes a support shaft 205*a* parallel to the axial direction of the rotation shaft 96*c*, and the coiled portion 213*b* is fitted around and supported by the support shaft 205*a*. Therefore, the center $O_3$ of the coiled portion 215*b*, which is the center of support of the torsion spring 215, is not on the axial line of the rotation axis O of the rotation shaft 96*c*. The rotation shaft 96*c*, the torsion spring 215, and the projection 202 are disposed such that, at the moment immediately before the contact portion 215*a* leaves the projection 202, the rotation axis O of the rotation shaft 96*c*, the center $O_3$ of the coiled portion 215*b*, and the contact point Q are approximately aligned with an identical straight line perpendicular to the axial direction of the rotation shaft 96*c*. In FIG. 42, broken lines represent a position at which an arm 215*d* of the torsion spring 215 is not bent, and the arm 215*d* is bent at a position PD.

Figure 43:
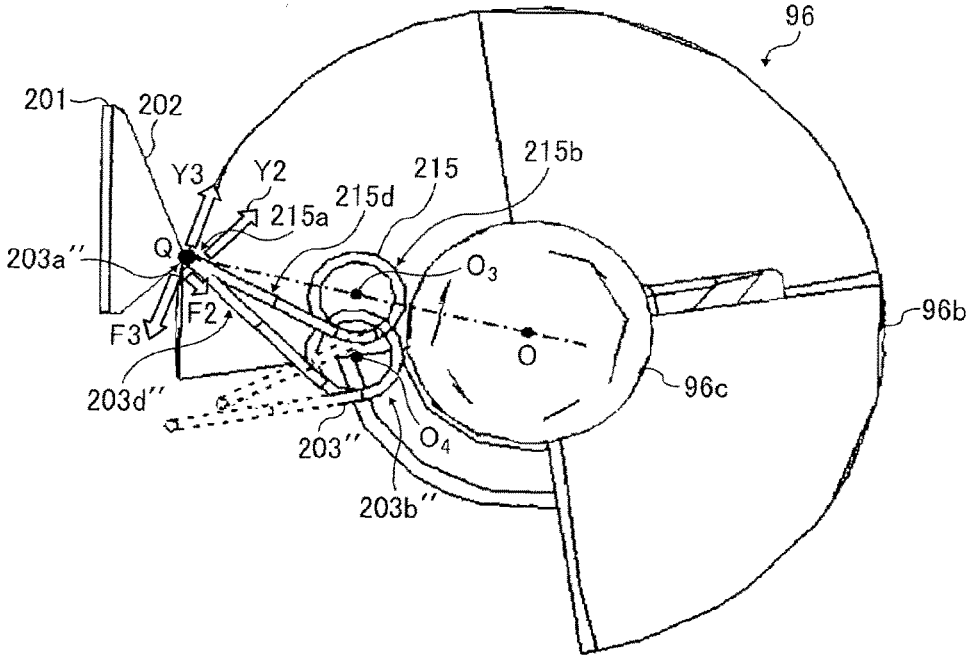
FIG. 43 illustrates the force applied to the torsion spring at the moment immediately before the torsion spring flips the vibration plate.

FIG. 43 illustrates the force applied to the torsion spring 215 at a moment immediately before the torsion spring 215 flips the vibration plate 201 (the contact portion 215*a* overstrides the projection 202). Broken lines represent a torsion spring 203" according to a comparative example. The torsion spring 203" includes a contract portion 203*a*", a coiled portion 203*b*" and an arm 203*d*". In the comparative example, the torsion spring 203" is disposed such that, at the moment immediately before the contact portion 203*a*"

leaves the projection 202, the rotation axis O of the rotation shaft 96*c*, a center $O_4$ of the coiled portion 203*b*", and the contact point Q are not aligned with an identical straight line perpendicular to the axial direction of the rotation shaft 96*c*.

It is to be noted that, at the moment immediately before the torsion spring 215 flips the vibration plate 201, the contact portion 215*a* is in contact with the projection 202 and inhibited from moving, and the load on the torsion spring 215 is greatest.

In the comparative example, although the rotation axis O of the rotation shaft 96*c* is approximately aligned with the contact point Q between the contact portion 203*a*" and the projection 202, the center $O_4$ of the coiled portion 203*b*" in the radial direction is not aligned with the rotation axis O and the contact point Q. Therefore, the direction indicated by arrow Y2, in which the torsion spring 203" can escape, does not match the direction of reactive force applied to the torsion spring 203" in the tangential direction as the rotation shaft 96*c* rotates. Accordingly, in the comparative example indicated by broken lines, while the torsion spring 203" is twisted to escape in the direction indicated by arrow Y2, the force in the direction (indicated by arrow F2) to bend the contact portion 203*a*" occurs.

By contrast, in the torsion spring 215 according to Embodiment 7, the direction indicated by arrow Y3, in which the torsion spring 215 escapes, matches the direction of reactive force (opposite to arrow F3) applied to the torsion spring 215 in the tangential direction as the rotation shaft 96*c* rotates. Then, the coiled portion 215*b* can absorb the reactive force, reducing the bending of the spring due to the force in the direction not to be absorbed. Therefore, the margin for the fatigue fracture of the torsion spring 215 over time can increase.

Embodiment 8

Next, Embodiment 8 is described below. It is to be noted that the structure and operation of the image forming apparatus according to the present embodiment are basically similar to those of Embodiment 1, and the descriptions thereof are omitted.

Figure 44:
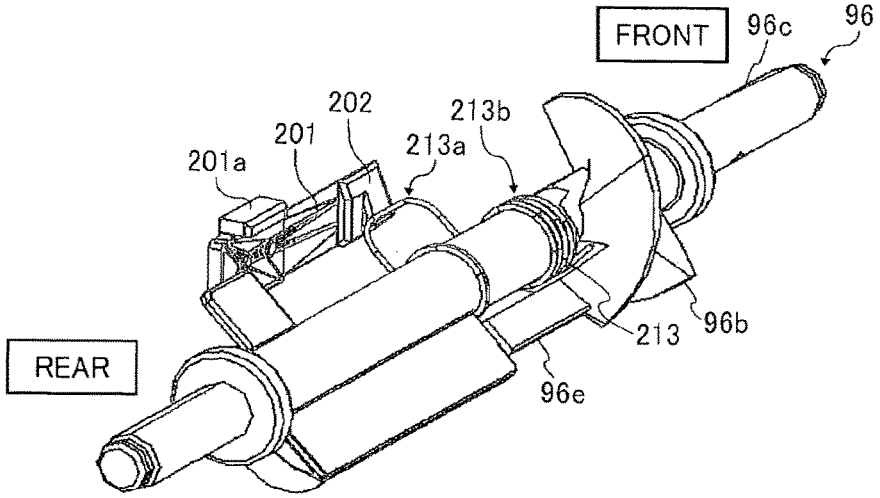
FIG. 44 is a perspective view of a structure to vibrate the vibration plate, according to Embodiment 8.
Figure 45:
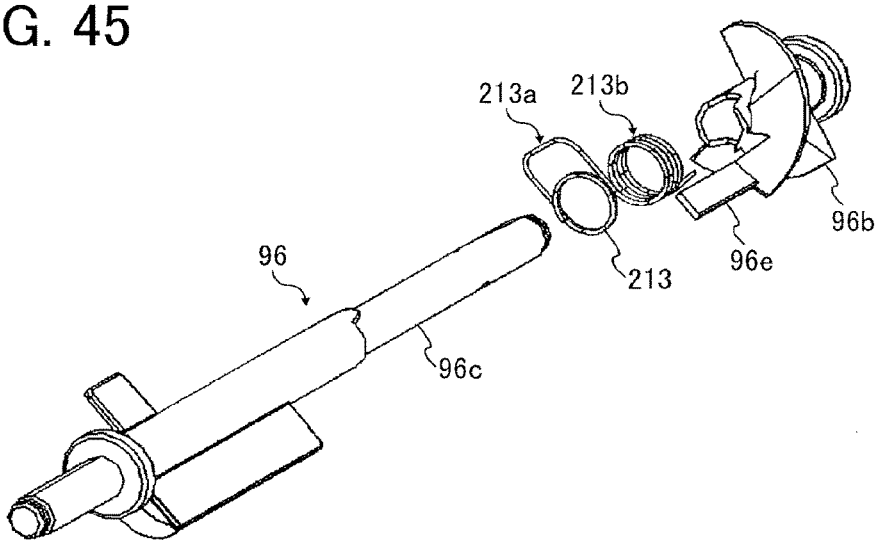
FIG. 45 is an exploded perspective view of the rotation shaft of the first stirring conveyor, the torsion spring, and a spiral blade illustrated in FIG. 44.

FIG. 44 is a perspective view of the torsion spring 213 and the screw blade 96*b* attached to the rotation shaft 96*c* of the first stirring conveyor 96. FIG. 45 is an exploded perspective view of the rotation shaft 96*c* of the first stirring conveyor 96, the torsion spring 213, and the screw blade 96*b*. In the present embodiment, as illustrated in FIG. 45, the screw blade 96*b* is removably attachable to the rotation shaft 96*c* from the right side in FIG. 45, from which the torsion spring 213 is attached to the rotation shaft 96*c* (front side in the axial direction). The coiled portion 213*b* is fitted around the rotation shaft 96*c* to attach the torsion spring 213 to the rotation shaft 96*c*, after which the screw blade 96*b* is attached to the rotation shaft 96*c*. Thus, the torsion spring 213 can be easily attached to the rotation shaft 96*c* such that the rotation center O of the rotation shaft 96*c* matches the radial center of the coiled portion 213*b*. Thus, assembling of the first stirring conveyor 96 is facilitated. When the screw blade 96*b* is attached to the rotation shaft 96*c* being inserted into the torsion spring 213, each of the screw blade 96*b* and the torsion spring 213 is secured to the rotation shaft 96*c* at a predetermined position in the axial direction of the rotation shaft 96*c* and at a predetermined angle in the rotation direction of the rotation shaft 96*c*.

Additionally, the screw blade 96*b* includes a stirring fin 96*e* projecting in the axial direction of the rotation shaft 96*c* to overlap the contact portion 213*a*. In the rotation direction of the rotation shaft 96*c*, the stirring fin 96*e* is disposed outside the range of movement of the contact portion 213*a*. The stirring fin 96*e* inhibits retention of toner or developer adjacent to the projection 202.

Embodiment 9

Next, Embodiment 9 is described below. It is to be noted that the structure and operation of the image forming apparatus according to the present embodiment are basically similar to those of Embodiment 1, and the descriptions thereof are omitted.

Figure 46:
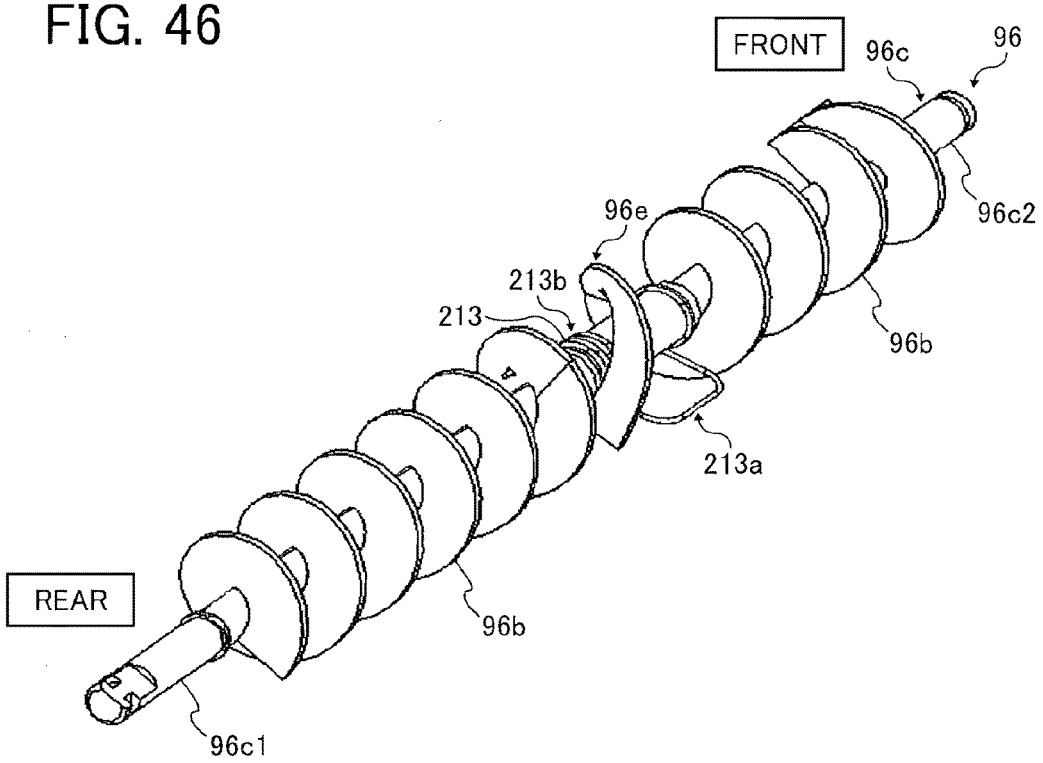
FIG. 46 is a perspective view of a torsion spring attached to a rotation shaft according to Embodiment 9.
Figure 47:
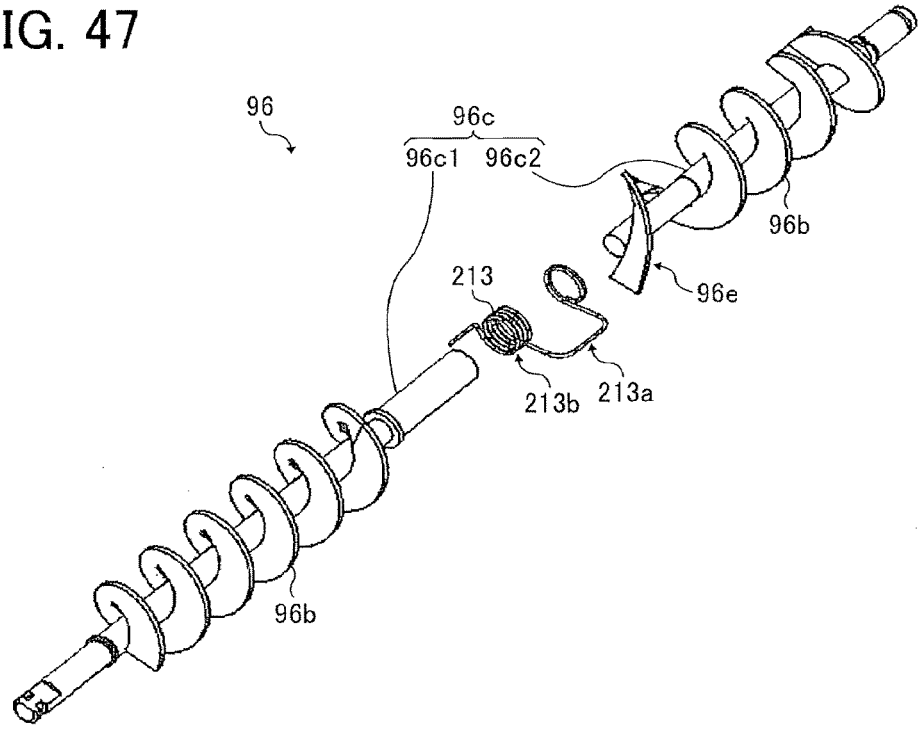
FIG. 47 is an exploded perspective view of a first shaft portion, a second shaft portion, and the torsion spring in the structure illustrated in FIG. 46.

FIG. 46 is a perspective view of the first stirring conveyor 96 in which the torsion spring 213 attached to the rotation shaft 96*c*. In FIG. 46, the rotation shaft 96*c* of the first stirring conveyor 96 includes a first shaft portion 96*c*1 and a second shaft portion 96*c*2. FIG. 47 is an exploded perspective view of the first shaft portion 96*c*1, the second shaft portion 96*c*2, and the torsion spring 213. In the present embodiment, as illustrated in FIG. 47, the second shaft portion 96*c*2 is removably attachable to the first shaft portion 96*c*1 from the right side in FIG. 45, from which the torsion spring 213 is attached to the first shaft portion 96*c*1 (front side in the axial direction). Each of the first shaft portion 96*c*1 and the second shaft portion 96*c*2 includes the screw blade 96*b*. The coiled portion 213*b* is fitted around the first shaft portion 96*c*1 of the rotation shaft 96*c*, thereby attaching the torsion spring 213 to the rotation shaft 96*c*, after which the second shaft portion 96*c*2 is coupled to the first shaft portion 96*c*1. Thus, the torsion spring 213 can be easily attached to the rotation shaft 96*c* such that the rotation center O of the rotation shaft 96*c* matches the radial center of the coiled portion 213*b*. Thus, assembling of the first stirring conveyor 96 is facilitated.

Additionally, the screw blade 96*b* of the second shaft portion 96*c*2 includes the stirring fin 96*e* projecting in the axial direction of the rotation shaft 96*c* to overlap the contact portion 213*a*. In the rotation direction of the rotation shaft 96*c*, the stirring fin 96*e* is disposed outside the range of movement of the contact portion 213*a*. The stirring fin 96*e* inhibits retention of toner or developer adjacent to the projection 202.

In Embodiment 9, a major capability of the first stirring conveyor 96 is developer conveyance in the axial direction, and the torsion spring 213 is disposed in the first stirring conveyor 96 such that the rotation axis O of the rotation shaft 96*c* matches the center of the coiled portion 213*b* in the radial direction. In such developer conveyors or stirring members, the external diameter is often limited. However, in the present embodiment, an arm length of the coiled portion 213*b* of the torsion spring 213 can be secured, and capability and durability of the first stirring conveyor 96 are higher.

Embodiment 10

Next, Embodiment 10 is described below. It is to be noted that the structure and operation of the image forming apparatus according to the present embodiment are basically similar to those of Embodiment 1, and the descriptions thereof are omitted.

Figure 48:
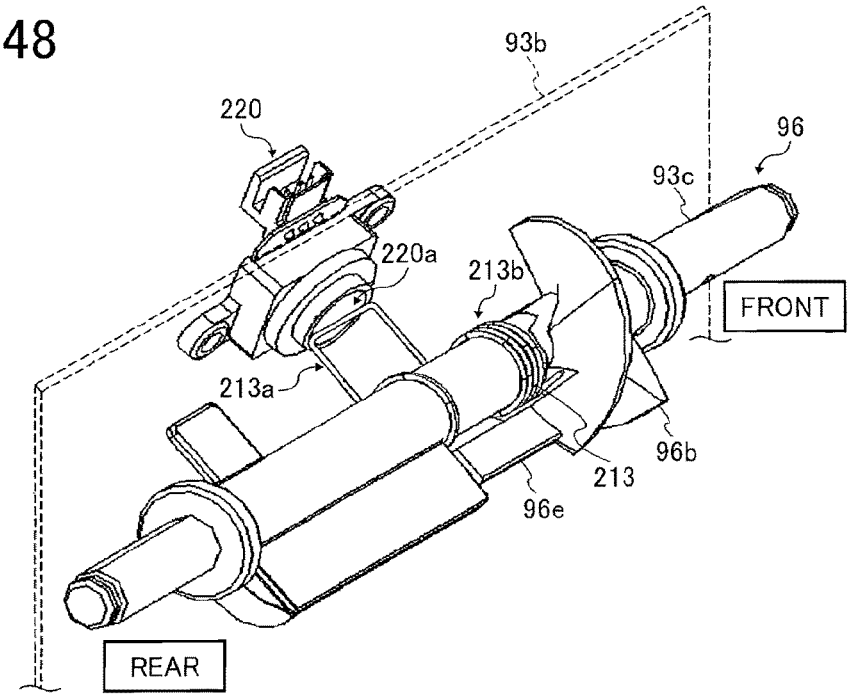
FIG. 48 is a perspective view of a first stirring conveyor according to Embodiment 10, to which a torsion spring to clean a toner detector and a spiral blade are attached.

FIG. 48 is a perspective view of the first stirring conveyor 96, to which the torsion spring 213 and the screw blade 96*b* are attached, and a toner detector 220 having a detection face 220*a* cleaned by the contact portion 213*a*. The toner detector 220 is disposed such that the detection face 220*a* is exposed to the interior of the sub-hopper 90 from the casing 93*b* indicated by broken lines in FIG. 48. The toner detector 220 can be a toner level sensor using piezoelectric vibration, a magnetic permeability sensor, a sensor using light transmission, or the like. In the present embodiment, as illustrated in FIG. 48, the torsion spring 213 cleans the detection face 220*a* of the toner detector 220 exposed to the interior of the sub-hopper 90 from the casing 93*b*. Accordingly, in the present embodiment, the vibration plate 201 and the projection 202 are not disposed in the sub-hopper 90. The first stirring conveyor 96 has a configuration similar to that described above with reference to FIGS. 44 and 45. In Embodiment 10, The arm length of the torsion spring 213 in Embodiment 10 is designed such that the contact portion 213*a* contacts and cleans the detection face 220*a*, which is on a plane identical to the inner face of the casing 93*b*. Accordingly, while facilitating assembling of the first stirring conveyor 96, the detection face 220*a* is kept clean to maintain the detection accuracy of the toner detector 220.

Additionally, the screw blade 96*b* includes a stirring fin 96*e* projecting in the axial direction of the rotation shaft 96*c* to overlap the contact portion 213*a*. In the rotation direction of the rotation shaft 96*c*, the stirring fin 96*e* is disposed outside the range of movement of the contact portion 213*a*. The stirring fin 96*e* inhibits retention of toner or developer adjacent to the detection face 220*a* of the toner detector 220.

The various aspects of the present specification can attain specific effects as follows.

Aspect A

Aspect A concerns a powder amount detector that includes a vibration plate (201) secured at a predetermined position inside a powder container (e.g., the developer reservoir 90*a*) to contain powder (e.g., developer), a contact member (e.g., the torsion spring 203) to vibrate the vibration plate, a vibration detector (e.g., the magnetic flux sensor 204) to detect vibration of the vibration plate; a detection result processor (e.g., the controller 20) to determine the amount of powder in the powder container according to a detection result generated by the vibration detector. In such a structure, the contact member is attached to a rotation shaft (e.g., the rotation shaft 96*c*) and flips the vibration plate to cause the vibration plate to repeat elastic deformation and reversion to vibrate. The contact member is configured to pass an area opposed to the vibration plate after the contact member flips the vibration plate by the time the vibration plate returns to a predetermined position in a stationary state.

After the contact member flips the vibration plate, if the contact member fails to quickly pass the area opposed to the vibration plate, the vibration plate contacts the vibration plate and hinders the vibration of the vibration plate.

According to Aspect A, after flipping the vibration plate, the contact member passes the area opposed to the vibration plate by the time the vibration plate returns to the predetermined position. Thus, the contact member does not contact the vibrating vibration plate. Since the contact member does not hinder the vibration of the vibration plate, the vibration detector can detect, with a higher accuracy, the vibration of the vibration plate in accordance with the amount of the powder in the powder container. Thus, this aspect suppresses degradations in detection accuracy of the powder amount in the powder container, based on the detection result generated by the vibration detector.

Aspect B

In Aspect A, the vibration detector includes a signal oscillator (e.g., the coil pattern 11) to output a signal corresponding to a state of a magnetic flux passing through a space opposed to the vibration detector. The vibration plate is made of a material to affect the magnetic flux and disposed facing the signal oscillator via a wall (e.g., the casing 93*b*) of the powder container to vibrate in a direction in which the vibration plate faces the signal oscillator. The detection result processor is configured to acquire, in regular sampling cycles, frequency-related data (e.g., the count value acquired from the count value output 33), which relates to the frequency of the oscillation signal of the signal oscillator and changes corresponding to vibration of the vibration plate, detect a vibration state of the vibration plate based on a change in the frequency-related data, and detect the amount of the powder in the powder storage based on the detected vibration state of the vibration plate. With this configuration, as described above, the detection accuracy can be higher than the detection accuracy of, for example, a pressure sensor.

Aspect C

In Aspect A or B, a first end of the vibration plate in an axial direction of the shaft is secured (e.g., via the mount 201*a* to the casing 93*b*), and the vibration plate includes a projection (202) projecting from a second end to be flipped by the contact member. The projection includes an inclined face (e.g., the second inclined face 202*c*) inclined to reduce a projecting amount of the projection in a rotation direction of the rotation shaft. This aspect inhibits the contact member from being caught by the projection of the vibration plate when the rotation shaft rotates in reverse, as described above.

Aspect D

In Aspect C, an apex at which the inclined face starts is disposed in a downstream portion of the projection in the rotation direction of the rotation shaft. According to this aspect, as described above, after flipping the projection, the contact member can quickly escape from the projection.

Aspect E

In any one of Aspects A through D, the contact member includes an elastic body, such as the torsion spring 203, biased to one side in the rotation direction of the rotation shaft. With this aspect, as described above, the elastic body exerts a resilience to cause the contact member to quickly pass the area opposed to the vibration plate. Accordingly, the vibration of the vibration plate is not hindered.

Aspect F

In any one of Aspects A through E, the contact member includes a torsion spring. With this aspect, as described above, the torsion spring exerts a spring resilience to quickly pass the area opposed to the vibration plate, and the vibration of the vibration plate is not hindered. Further, the durability of the contact member is enhanced.

Aspect G

In Aspect F, the torsion spring includes a contact portion (203*a*) to contact the vibration plate and a first coiled portion and a second coiled portion connected to ends of the contact portion, respectively. A first end of the first coiled portion is connected to the contact portion, and a second end of the first coiled portion is held by a spring end support disposed on the rotation shaft. A first end of the second coiled portion is connected to the contact portion, and a second end of the second coiled portion is kept free. With this configuration, the contact impact between the torsion spring and the vibration plate is absorbed, and wear of the contact portion of the vibration plate that contacts the torsion spring is suppressed.

Aspect H

In any one of Aspects A through E, the contact member includes one of a wire and a rod. With this configuration, as described above, the powder is inhibited from agglomerating between the vibration plate and the contact member.

Aspect I

In any one of Aspects A through H, a rotation center of the contact member is disposed below a position (e.g., the contact position A) or a range (e.g., the first inclined face 202*a* and the apex 202*b*) in which the contact member contacts the vibration plate. With this aspect, as described above, the contact member does not disturb the vibration of the vibration plate, and the amount of the powder can be detected accurately.

Aspect J

In Aspect I, a first end of the vibration plate in the axial direction of the shaft is secured (e.g., via the mount 201*a* to the casing 93*b*), and a second end of the vibration plate, opposite the first end, includes the projection (202) to be flipped by the contact member. The projection includes an upstream inclined face (e.g., the first inclined face 202*a*) to increase a projecting amount of the projection in the rotation direction of the rotation shaft, a downstream inclined face (e.g., the second inclined face 202*c*) to reduce the projecting amount in the rotation direction of the rotation shaft, and an apex (202*b*) at which the projecting amount is greatest. The upstream inclined face, the apex, and the downstream inclined face are disposed sequentially in the rotation direction of the rotation shaft. An inclination of the downstream inclined face is greater than an inclination of the upstream inclined face. With this aspect, as described above, the contact member does not disturb the vibration of the vibration plate, and the amount of the powder can be detected accurately.

Aspect K

In any one of Aspects A through J, a pad (e.g., the pad 206*a*) is disposed on at least the contact portion of the contact member. With this aspect, as described above, the durability of the contact member is enhanced.

Aspect L

In aspect K, the pad is a tubular elastic body and rotatable relative to the contact portion. With this aspect, as described above, the durability of the contact member is enhanced further.

Aspect M

In any one of Aspects A through J, the contact member (e.g., the torsion spring 213) includes the contact portion (213*a*) to contact the vibration plate and a coiled portion (213*b*) connected to the contact portion. The rotation shaft is disposed in a hollow inside the coiled portion such that the rotation center of the coiled portion matches the rotation center of the rotation shaft. With this aspect, as described above, the durability of the contact member is enhanced.

Aspect N

In any one of Aspects A through J, the contact member (e.g., the torsion spring 213) includes the contact portion (213*a*) to contact the vibration plate and a coiled portion (213*b*) connected to the contact portion. The rotation shaft, the contact portion, and the vibration plate are disposed such that, at a moment immediately before the contact portion leaves the vibration plate, the rotation center (i.e., rotation axis O) of the rotation shaft, the rotation center ($O_3$) of the coiled portion, and the contact point (Q) are aligned with an identical straight line perpendicular to the axial direction of the rotation shaft. With this aspect, as described above, the durability of the contact member is enhanced.

Aspect O

In Aspect N, the rotation center of the coiled portion is inconsistent with the rotation center of the rotation shaft. As described above, this aspect increases a margin for fatigue fracture with the elapse of time of the contact member.

Aspect P

In Aspect M or N, the powder amount detector further includes an agitator (e.g., the screw blade 96*b*) to rotate coaxially with the rotation shaft to stir or transport the powder, and the agitator is removably attached to one end of the rotation shaft that is inserted into the coiled portion. According to this aspect, as described above, the rotation shaft is inserted into the coiled portion to attach the contact member to the rotation shaft, after which the agitator (e.g., the screw blade 96*b*) is attached to the rotation shaft. Accordingly, the contact member can be easily attached to the rotation shaft such that the rotation center (O) of the rotation shaft matches the radial center of the coiled portion. Thus, attachment of the contact member is facilitated.

Aspect Q

In Aspect P, the agitator such as the screw blade 96*b* includes a projecting portion projecting in the axial direction of the rotation shaft to overlap the contact portion. The projecting portion is disposed outside the range of movement of the contact portion in the rotation direction of the rotation shaft. With this configuration, as described above in Embodiments 8 and 9, retention of the powder adjacent to the vibration plate is inhibited.

Aspect R

Aspect R concerns a powder amount detector that includes a powder container, such as the sub-hopper 90, to contain powder such as toner; a powder detector, such as the toner detector 220, disposed on a wall face (e.g., the casing 93*b*) of the powder container to detect the powder at a height at which the powder detector is disposed; a cleaner to rotate around the rotation shaft 96*c* inside the powder container to clean the detection face 220*a* of the powder detector; and an agitator, such as the screw blade 96*b*, to rotate coaxially with the rotation shaft 96*c* to stir or transport the powder. The cleaner includes a contact portion (213*a*) and a coiled portion (213*b*) connected to the contact portion, and the rotation shaft is inserted into the coiled portion such that the rotation center of the coiled portion matches the rotation center of the rotation shaft. The agitator is removably attached to one end of the rotation shaft that is inserted into the coiled portion of the cleaner. According to this aspect, as described in Embodiment 10, while facilitating assembling of the powder conveyor, the detection face is kept clean to maintain the detection accuracy of the toner detector. Various sensors, such as a piezoelectric sensor, can be used as the powder detector.

Aspect S

In Aspect R, at least a portion (e.g., stirring fin 96*e*) of the agitator (e.g. the screw blade 96*b*) projects to overlap the contact portion (213*a*) in the axial direction of the rotation shaft, and, in the rotation direction of the rotation shaft, the portion projecting is disposed outside the range of movement of the contact portion. With this configuration, as described above in Embodiment 10, retention of the powder adjacent to the detection face 220*a* of the powder detector is inhibited.

Aspect T

Aspect T concerns a powder supply device that includes a temporary powder container, which stores the powder supplied from an upstream container and discharges the powder to a destination, and the powder amount detector according to any one of Aspects A through S, to detect the amount of the powder in the temporary powder container. As described above, this aspect enables detection, with a higher degree of accuracy, of the amount of the powder in the temporary powder container.

Aspect U

Aspect U concerns an image forming apparatus such as the image forming apparatus 100 that includes an image bearer (e.g., the photoconductor drum 109), a developing device (e.g., the developing device 112), an upstream container (e.g., the developer bottle 117), and the powder supply device according to Aspect T, to supply the developer to the developing device as the destination. As described above, this aspect enables detection, with a higher degree of accuracy, of the amount of the developer in the temporary powder container. Accordingly, the amount of developer supplied to the developing device is stabilized, thereby inhibiting decreases in the image density, and the image forming apparatus forms preferable images.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A powder amount detector comprising:

a vibration plate secured to a powder container to contain powder and positioned at a predetermined position in a stationary state;

a shaft to rotate inside the powder container;

a contact member attached to the shaft, the contact member to flip the vibration plate to cause the vibration plate to repeat elastic deformation and reversion to vibrate, the contact member to exit an area opposed to the vibration plate by the time the vibration plate returns to the predetermined position after the contact member flips the vibration plate;

a vibration detector to detect vibration of the vibration plate; and a detection result processor to determine an amount of the powder in the powder container according to a detection result generated by the vibration detector.

2. The powder amount detector according to claim 1, further comprising a frequency-related data output to output frequency-related data, wherein the vibration detector includes a signal oscillator to output an oscillation signal having a frequency corresponding to a state of a magnetic flux passing through a space opposed to the vibration detector, wherein the vibration plate is made of a material to affect the magnetic flux and disposed facing the signal oscillator via a wall of the powder container to vibrate in a direction in which the vibration plate faces the signal oscillator, wherein the frequency-related data relates to the frequency of the oscillation signal of the signal oscillator and changes corresponding to vibration of the vibration plate in regular sampling cycles, wherein the detection result processor is configured to acquire the frequency-related data, detect a vibration state of the vibration plate based on a change in the frequency-related data, and detect the amount of the powder in the powder container based on the detected vibration state of the vibration plate.

3. The powder amount detector according to claim 1, wherein a first end of the vibration plate in an axial direction of the shaft is secured, wherein the vibration plate includes a projection projecting toward the shaft from a second end opposite the first end, the projection to be flipped by the contact member, and wherein the projection includes an inclined face to reduce a projecting amount of the projection in a rotation direction of the shaft.

4. The powder amount detector according to claim 3, wherein the projection has an apex at which the inclined face starts, the apex disposed in a downstream portion of the projection in the rotation direction of the shaft.

5. The powder amount detector according to claim 1, wherein the contact member includes an elastic body biased to one side in a rotation direction of the shaft.

6. The powder amount detector according to claim 1, wherein the contact member includes a torsion spring.

7. The powder amount detector according to claim 6, wherein the shaft includes a spring end support, wherein the torsion spring includes:

a contact portion to contact the vibration plate; and a first coiled portion and a second coiled portion connected to ends of the contact portion, respectively, wherein a first end of the first coiled portion is connected to the contact portion, and a second end of the first coiled portion is supported by the spring end support, and wherein a first end of the second coiled portion is connected to the contact portion, and a second end of the second coiled portion is a free end.

8. The powder amount detector according to claim 1, wherein the contact member includes one of a wire and a rod.

9. The powder amount detector according to claim 1, wherein a rotation center of the contact member is disposed lower than a range of the vibration plate in which the contact member contacts.

10. The powder amount detector according to claim 9, wherein a first end of the vibration plate in an axial direction of the shaft is secured, and wherein the vibration plate includes a projection projecting toward the shaft from a second end opposite the first end, the projection to be flipped by the contact member and including:

an upstream inclined face to increase a projecting amount of the projection in a rotation direction of the shaft;

a downstream inclined face to reduce the projecting amount in the rotation direction of the shaft, the downstream inclined face positioned downstream from the upstream inclined face in the rotation direction of the shaft, the downstream inclined face greater in inclination than the upstream inclined face; and an apex at which the projecting amount is greatest, the apex positioned between the upstream inclined face and the downstream inclined face.

11. The powder amount detector according to claim 1, further comprising a pad disposed on at least a contact portion of the contact member to contact the vibration plate.

12. The powder amount detector according to claim 11, wherein the pad is a tubular elastic body and rotatable relative to the contact portion.

13. The powder amount detector according to claim 1, wherein the contact member includes:

a contact portion to contact the vibration plate; and a coiled portion connected to the contact portion, and wherein the shaft is disposed in a hollow inside the coiled portion such that a rotation center of the coiled portion matches a rotation center of the shaft.

14. The powder amount detector according to claim 13, further comprising an agitator to rotate coaxially with the shaft to stir or transport the powder, the agitator removably attached to one end of the shaft that is inserted into the coiled portion.

15. The powder amount detector according to claim 14, wherein the agitator includes a projecting portion projecting in an axial direction of the shaft to overlap the contact portion, the projecting portion disposed outside a range of movement of the contact portion in a rotation direction of the shaft.

16. The powder amount detector according to claim 1, wherein the contact member includes:

a contact portion to contact the vibration plate; and a coiled portion connected to the contact portion, and wherein the shaft, the contact member, and the vibration plate are disposed such that, at a moment immediately before the contact portion leaves the vibration plate, a rotation center of the shaft, a rotation center of the coiled portion, and a contact point between the contact portion and the vibration plate are aligned with an identical straight line perpendicular to an axial direction of the shaft.

17. The powder amount detector according to claim 16, wherein the vibration plate includes a projection projecting toward the shaft, the projection to be flipped by the contact member and including:

an upstream inclined face to increase a projecting amount of the projection in a rotation direction of the shaft;

a downstream inclined face to reduce the projecting amount in the rotation direction of the shaft, the downstream inclined face positioned downstream from the upstream inclined face in the rotation direction of the shaft; and an apex between the upstream inclined face and the downstream inclined face, and wherein the contact portion of the contact member contacts the apex of the projection at the moment immediately before leaving the vibration plate.

18. The powder amount detector according to claim 16, wherein the rotation center of the coiled portion is inconsistent with the rotation center of the shaft.

19. A powder supply device comprising:

the powder container to store the powder;

an upstream powder supply passage to connect the powder container to an upstream container from which the powder is supplied to the powder container;

a downstream powder supply passage to connect the powder container to a destination to which the powder is supplied from the powder container; and the powder amount detector according to claim 1, to detect the amount of the powder in the powder container.

20. An image forming apparatus comprising:

an image bearer to bear a latent image;

a developing device to develop the latent image on the image bearer with developer;

the upstream container to contain the developer supplied to the developing device; and the powder supply device according to claim 19, to supply the developer to the developing device.

* * * * *